US007597124B2

(12) United States Patent
Litto

(10) Patent No.: US 7,597,124 B2
(45) Date of Patent: Oct. 6, 2009

(54) PRESERVATION AND DISPENSATION BY VOLUMETRIC DISPLACEMENT UTILIZING POTENTIAL ENERGY CONVERSION

(76) Inventor: Claude Litto, P.O. Box 6201, Laconia, NH (US) 03247

( * ) Notice: Subject to any disclaimer, the term of this patent is extended or adjusted under 35 U.S.C. 154(b) by 419 days.

(21) Appl. No.: 10/862,717

(22) Filed: Jun. 7, 2004

(65) Prior Publication Data

US 2005/0268985 A1 Dec. 8, 2005

(51) Int. Cl.
*B65B 1/04* (2006.01)
*B65D 35/28* (2006.01)

(52) U.S. Cl. ..... 141/285; 141/4; 141/67; 141/95; 141/114; 222/95; 222/105; 222/399

(58) Field of Classification Search ..... 141/2, 141/4, 10, 20, 67, 95, 98, 114, 285; 222/394, 222/399, 95, 105
See application file for complete search history.

(56) References Cited

U.S. PATENT DOCUMENTS 262,773 A 8/1882 Hohl
2,762,534 A 9/1956 Kish
4,921,135 A * 5/1990 Pleet ..... 222/82
5,118,009 A * 6/1992 Novitsky ..... 222/1
5,240,144 A 8/1993 Feldman
5,251,787 A * 10/1993 Simson ..... 222/95
5,322,094 A 6/1994 Janesko
5,368,195 A * 11/1994 Pleet et al. ..... 222/52
5,947,339 A * 9/1999 Boshears et al. ..... 222/183
6,152,189 A * 11/2000 Wright et al. ..... 141/2
6,161,726 A * 12/2000 Parsons et al. ..... 222/52
6,182,863 B1 2/2001 Van der Meer
6,220,311 B1 4/2001 Litto
6,269,980 B1 * 8/2001 Randall et al. ..... 222/145.5
6,375,048 B1 4/2002 Van der Meer
6,454,131 B1 9/2002 Van der Meer
6,502,725 B1 * 1/2003 Alexander ..... 222/185.1
6,540,111 B2 * 4/2003 Sunnarborg ..... 222/129
6,571,977 B2 * 6/2003 Goncalez et al. ..... 220/506
6,598,763 B2 7/2003 Van der Meer

* cited by examiner

*Primary Examiner*—Timothy L Maust

(57) ABSTRACT

A volumetric displacement device, especially good for preserving and dispensing carbonated beverages has been constructed that is extremely light, small, safe, attractive, easy to use, energy efficient and inexpensive. It can use battery power, has an ovaloid shape, can be constructed of thin flexible plastics, and operates in various positions that eliminate the need for a pickup tube. A consistent problem with soda savers, in that they destroy carbonated beverages by delivering them in a violent manner, has been solved by utilizing a low pressure delivery mode. The described volumetric displacement device can operate in a conventional refrigerator.

24 Claims, 23 Drawing Sheets

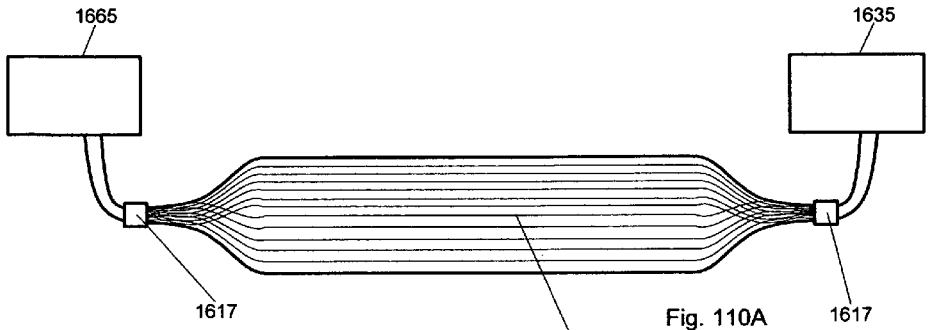
Fig. 110A
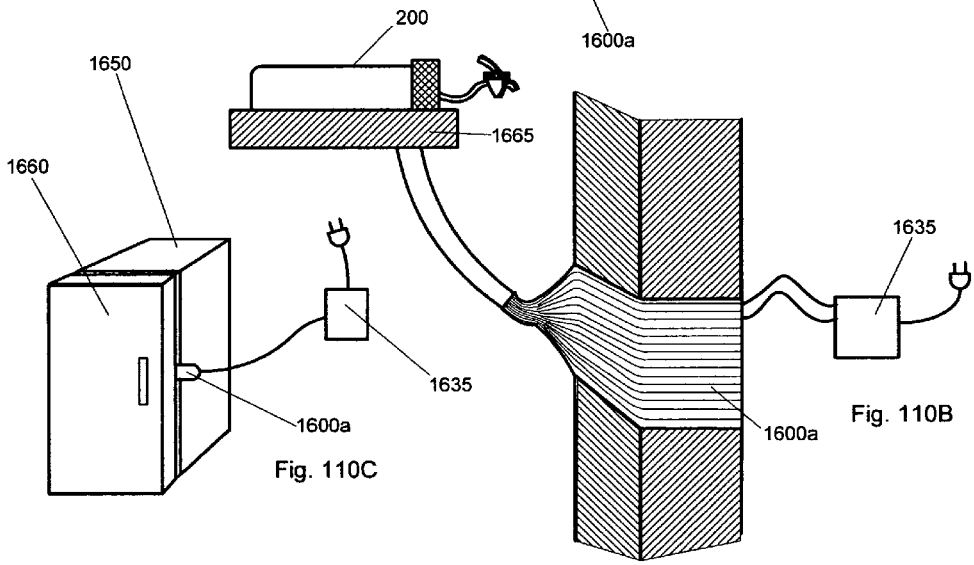
Fig. 110C
Fig. 110B
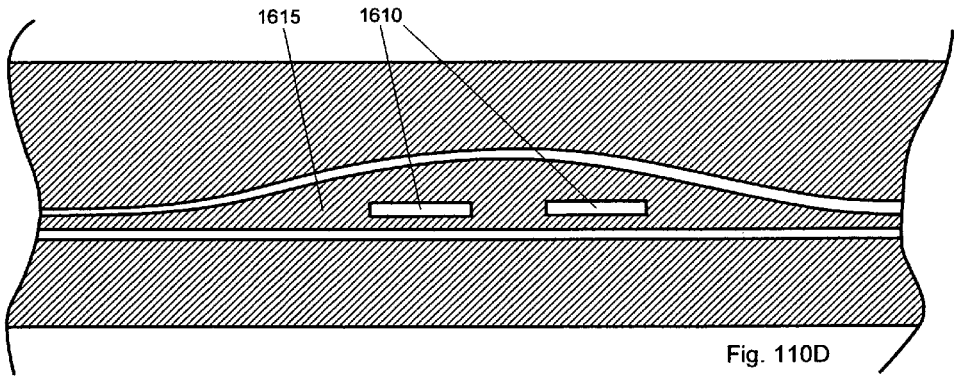
Fig. 110D

PRESERVATION AND DISPENSATION BY VOLUMETRIC DISPLACEMENT UTILIZING POTENTIAL ENERGY CONVERSION

CROSS-REFERENCE TO RELATED APPLICATIONS

This is the first filing and is an initial filing. Terms, theory of operation and concepts of preservation and dispensation by volumetric displacement are introduced in U.S. Pat. No. 6,220,311, granted in 2001, to author and inventor, Litto.

BACKGROUND OF THE INVENTION

1. Field of Invention

The present invention relates to the field of storing and dispensing materials, with particular application to containers with contents that are partially consumed and particular application to carbonated beverages.

2. Discussions of Prior Art

Containers, when partially emptied of their contents, exhibit a wide range of undesirable characteristics. Unless special and often expensive procedures are used, atmosphere enters the container and pollutes it with undesirable elements such as water vapor, air born contaminates, or unwanted oxygen. Another undesirable characteristic of a partially emptied container is the tendency for the usable material in the container to loose gas, off gassing to the air space left in the container. Off gassing results in premature curing or damaging of products. It results in loss of material. One particularly poignant example of off gassing damage is that which occurs to partially consumed portions of effervescent beverages. Effervescent beverages such as soda, champagne, sparkling wines, coolers, beer and the like, have CO2 gas dissolved in them, at pressure. Unfortunately the carbonated beverage is stored under pressure in the bottle and after the bottle is opened, the best part of the gas is free is escape the beverage, and the drink goes flat. Even if the cap is replaced, the gas is free to go into the air above the drink, and the bigger that space gets as the drink is "used up", the more gas can escape and the poorer the drink tastes. A second opening of the container compounds the problem and accelerates the damage to the beverage. Leaving a very small amount of beverage at the bottom of the container, will yield in a day, a drink that is almost devoid of effervescence and foremost people, worthless.

Preserving the unused portion of effervescent beverages has also over time proved to be a difficult problem to address economically. Pumps have been developed which will repressurize opened bottles of effervescent material as exemplified by the device disclosed in U.S. Pat. No. 5,322,094 granted to Janesko, 1994. These cumbersome to use as each time the container is opened, the entire container must be repressurized. In addition, CO2, the gas used for carbonating drinks will transfer, in part, to the air pumped into the container, as the air has too low a partial pressure of CO2 as it is pumped from the atmosphere into the container. The beverage still goes flat despite all the pumping.

The concept of filling a container with alternate material to keep it full and preserve the contents has been embodied in previous patents. Hohl, U.S. Pat. No. 262,773, granted in 1882, shows an apparatus for insertion into a beer keg, the apparatus having a bladder attached that is filled with water from a reservoir mounted above the keg. The reservoir is utilized to fill the bladder with water as beer is removed from the keg via a tap mounted in the keg. A pipe is fitted between the reservoir and the keg. Water flows down a pipe from the reservoir and fills the bladder. A similar device is described by Kish, U.S. Pat. No. 2,762,534, granted in 1956. Fluid is forced into a pipe which runs into the keg and into a bladder, that pressure causing beer to flow out another pipe with connection to the inside of the beer keg. Valves are used to regulate that pressure flow. This prior art has not seen wide spread utilization because it is expensive to purchase and extremely cumbersome to use especially in the home environment.

An advancement was seen when it was figured out the a conventional PET container could be used as the "bladder". Feldman in U.S. Pat. No. 5,240,144, 1993 describes deforming a conventional PET bottle in a pressurized chamber for the purpose of preservation and dispensation. Using the bottle as the displacement partition is a huge advantage. The beverage is already sold in it, so another bladder does not have to be inserted into the bottle. This reduces contamination threats. It is faster and easier to buy the beverage already in the displacement partition without having to add the partition latter. The described device has some drawbacks. It is relatively complicated, cumbersome and expensive to produce. It requires a refrigeration unit, to keep the beverage cool. It has no means described to prevent the violent delivery of the beverage that would destroy the carbonation. The pressure chamber has thick walls in it's description, and would present safety hazards for some people, such as children to operate. It is not easily transportable, the way a conventional PET bottle of soda is.

Volumetric Displacement devices are more fully described in U.S. Pat. No. 6,220,311, granted in 2001, to author Litto, entitled "Preservation and Dispensation by Volumetric Displacement". Litto introduces the terminology and concepts in U.S. Pat. No. 6,200,311 that are used in this current document. The reader may refer to U.S. Pat. No. 6,200,311 for information concerning the theory of operation and other aspects of Volumetric displacement device's.

The various apparatus described by the various inventors above does not, however, contain the advancements that the current work described in this patent embodies. The previously described devices are large, cumbersome, complicated, unsafe, expensive to produce, heavy, hard to use, difficult to design, difficult to manufacture, of poor material, or work poorly in one way or another in relation to the advances described herein.

Current human pumps to pressurize bottles, such as the unit made by Jakari, a finger pump fitting on the top of the container, and pushing compressed air into it, do not protect the soda. The CO2 gas permeates the compressed air, and the soda goes flat.

Many so called soda savers, do not work effectively. They allow much of the CO2 gas to escape.

Many current soda savers need pickup tubes that deliver the soda from the bottom of the container to the top, so as to avoid any CO2 gas that has come out of the soda.

OBJECTS AND ADVANTAGES

Accordingly, a number of advantages are achieved over the prior art.

The device described, called a volumetric displacement device, is small and light. It is designed so that when the bottle of beverage is placed into it, the advances in technology allow the loaded device to be only a little bigger and heavier than the conventional PET bottle of beverage was in the first place.

The device is battery operated. With this advancement, the "power cord" is cut, so that the device will store in the refrigerator.

The outside container is constructed with technology that is similar to that of a conventional PET bottle. In this manner it is very light weight, very strong, very safe. The container for the beverage can be constructed in a manner that lets it weigh little more than the weight of a conventional PET bottle.

The apparatus that pumps air, is designed to be miniaturized, and thus fits in a space around the neck of the PET bottle. The space needed is so small, that the volumetric displacement device is only a tiny bit longer than a conventional PET bottle, and only a little bit wider.

This device is so small and light, that a child can carry it around.

The safety of the proven PET container is safe enough so that a child could operate this volumetric displacement device.

With small amounts of material need to make this device, it will be relatively inexpensive to produce.

Versions can be made that need no batteries or electric compressor. Human powered pumps will keep perfect soda. Simplified embodiment add little more than another light container to the existing conventional PET container.

The described volumetric displacement device can be operated so that it loses very little CO2 gas. Any free CO2 gas that comes out of the soda, remains in the device, and can be pushed back into the carbonated beverage, re-carbonating it.

The device has a high pressure save mode for storing soda and rejuvenating it. It also has a low pressure delivery mode that allows the soda to exit the container gently, so as to not make it foam up, and not disturb and thus driving out the CO2 gas from it.

The device is small, light and simple enough that it can be used as a sipping container. As a sipper, soda can be consumed directly from it as the user sips the soda into their mouth.

The described device needs no pick up tube. By utilizing a position of the bottle where the neck is down or horizontal, any free CO2 is near the feet of the bottle and away from the neck. As beverage comes out the neck, the CO2 gas bubble is far away.

The device needs no internal refrigeration capability. It stores in the refrigerator. This conserves energy over the prior art as there is no extra surface area absorbing heat from the environment with the volumetric displacement device in the refrigerator.

The device is simple to operate.

The device has fail safe operation in the event of over pressurization. Since the construction is so light, there is nothing to "fly" if the container fails. If the container opens, the light weight PET bottle like shapes push air and stop as they are like parachutes in the air.

The device works in a variety of positions. It can work horizontally or vertically. It has feet on three sides, to work in each of three positions. It can work in the refrigerator, and pour while in the refrigerator with the refrigerator door open. It can be stood up next to the milk bottles, or stored horizontally next to the egg cartons. It works in both positions.

The device is very attractive. The clear volumetric displacement device allows the bottles of beverage to be viewed. The user can watch them being crushed. Feed back is provided as to the condition of the apparatus and the beverage stored, as it is all readily viewable.

The described device has a convenient pouring hose that makes it easy to put beverage into a glass without picking up the container. It is easier to pour with the hose nozzle, than to pick up a big bottle of soda. Elderly or otherwise weakened people can pour soda that someone else loaded in the volumetric displacement device, without having to pick up a bottle.

The device allows a user to purchase large conventional 3 liter bottles of soda for much less cost than purchasing the same amount of soda in single serving containers. The deposits in container deposit states will be mostly eliminated.

A single volumetric displacement device can work with different sized containers, including 16 oz, 20 oz, 1 liter, 2 liter and 3 liter conventional PET bottles.

Soda can be purchased in containers that can be used both in conventional manners, and in the volumetric displacement device.

The volumetric displacement device described can use rechargeable batteries. Discharged batteries can be exchanged for charged ones. Batteries can be recharged in the volumetric displacement device.

The volumetric displacement device described has an integrated compressor closure assembly, with the compressor built into the same piece of plastic that closes the volumetric displacement device container and the bottle. This is a very simple one piece design that makes the described volumetric displacement device esthetics pleasing, easy to use, and simple in concept to the user.

A method is described to prevent over pressurization of the soda upon installation of a new bottle of soda or other carbonated beverage.

The described volumetric displacement device can be built with far fewer parts than any previously described energy powered volumetric displacement device, and thus is inexpensive to build.

SUMMARY

The described volumetric displacement device functions a carbonated beverage saver and dispenser. Carbonated soft drinks in bottles stay carbonated even after the contents of the bottle is partially consumed.

A volumetric displacement device has been constructed that is extremely light, small, safe, attractive, easy to use, energy efficient and inexpensive. It can use battery power, has an ovaloid shape, can be constructed of thin plastics, and operates in various positions that eliminate the need for a pickup tube. A consistent problem with soda savers, in that they destroy carbonated beverages by delivering them in a violent manner, has been solved by utilizing a low pressure delivery mode. It can be used for most any carbonated beverage.

DRAWINGS

FIG. 1 shows an overview of a volumetric displacement device for storing and dispensing carbonated beverages utilizing a battery, a conventional PET bottle as a displacement partition, an ovaloid container with bell feet, separate delivery and save modes, and an integrated pump and container closure rotating relative to the bottle within the ELB space.

FIG. 5*a-e* show a series of figures which portray the concept of ovaloid.

Figure 15:
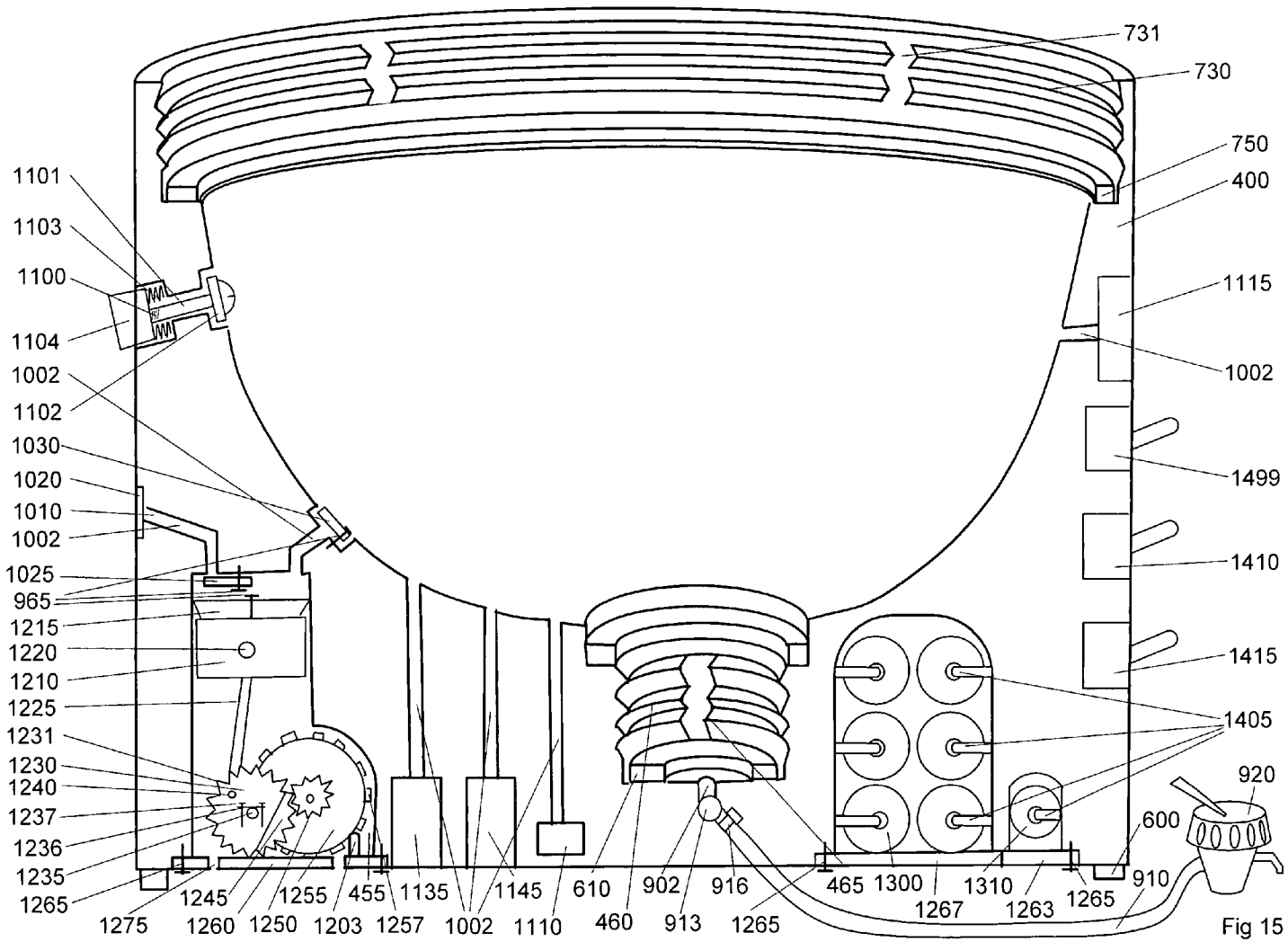
FIG. 15 shows a more detailed view of the container closure for the volumetric displacement device depicted in FIG. 1.
Figure 15A:
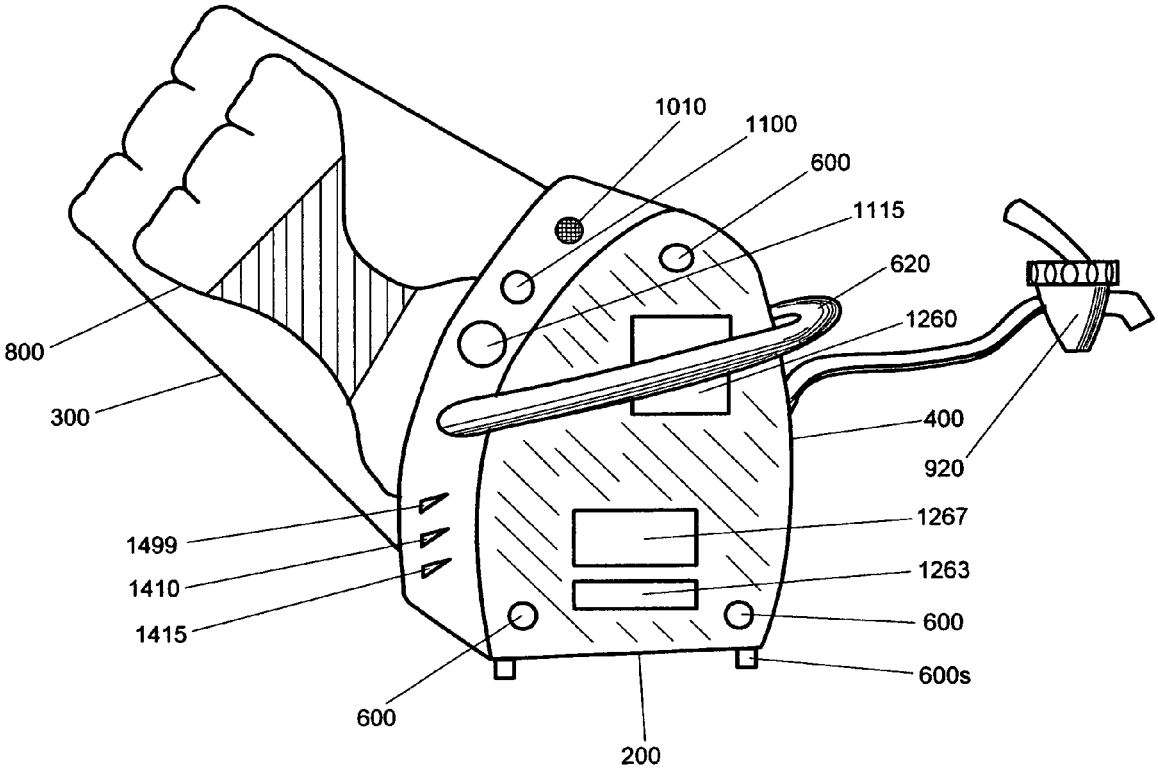

FIG. 15*a* show an exterior view of the container closure depicted in FIG. 15.

Figure 20:
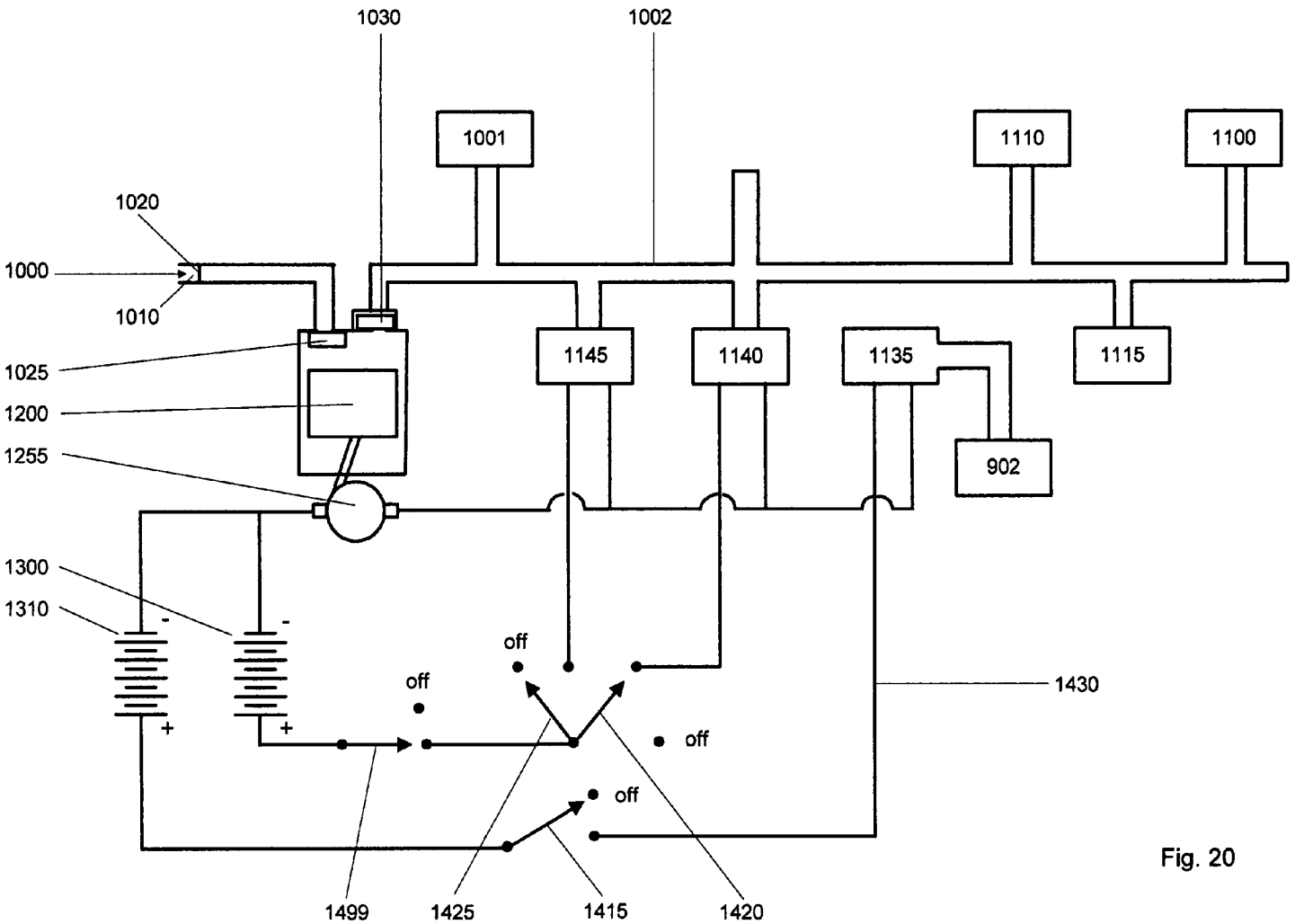

FIG. 20 shows a diagram of the displacement matter passageways and electrical schematics and the user controls.

Figure 20A:
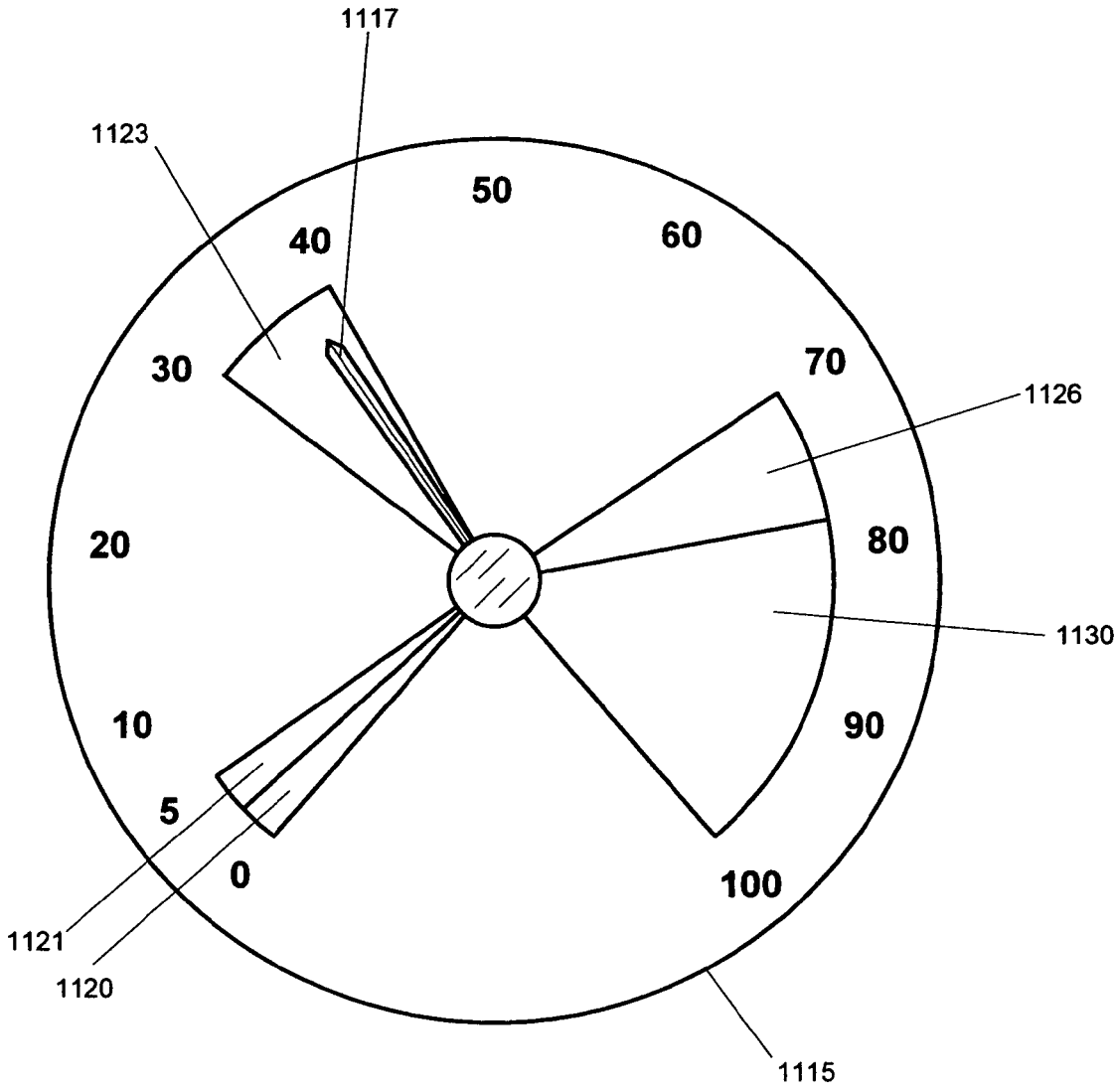

FIG. 20*a* shows a pressure gauge with areas colored that delineate different pressure modes. {trans}

Figure 30A:
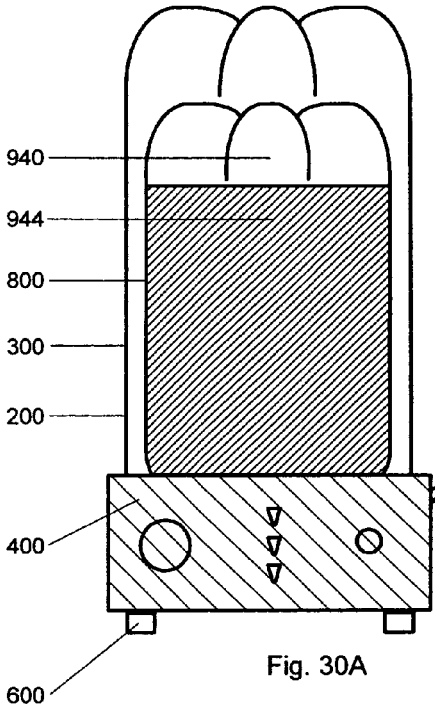
Figure 30C:
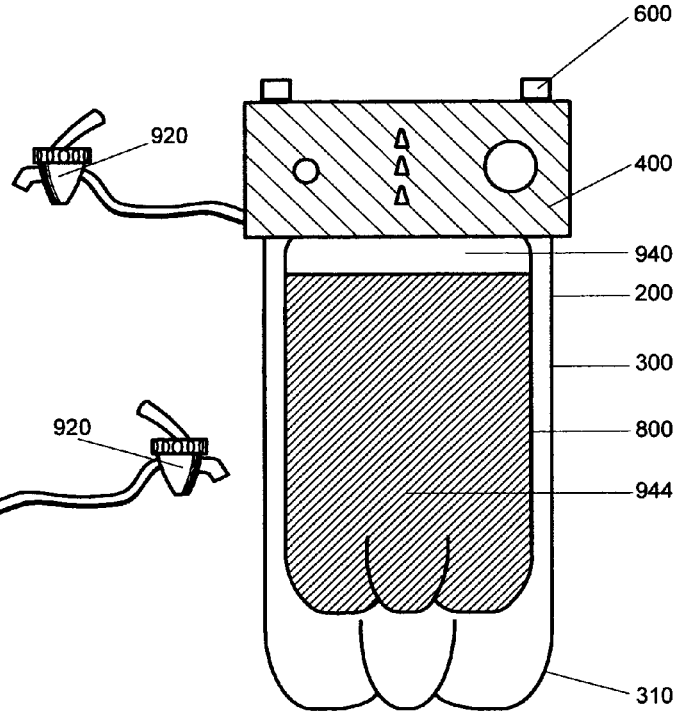
Figure 30B:
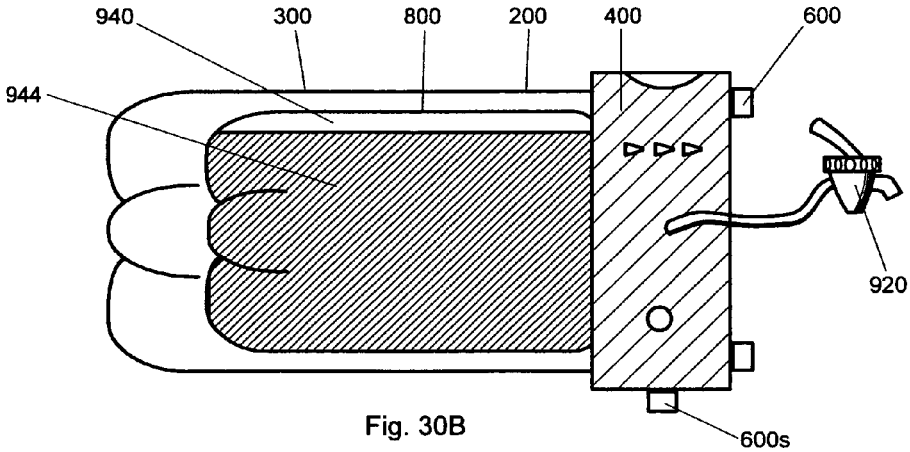

FIG. 30*a-c* shows Volumetric displacement devices in various positions.

FIG. 30*a* shows the neck down position.

FIG. 30*b* shows the neck horizontal position.

FIG. 30*c* shows the neck up position.

Figure 40:
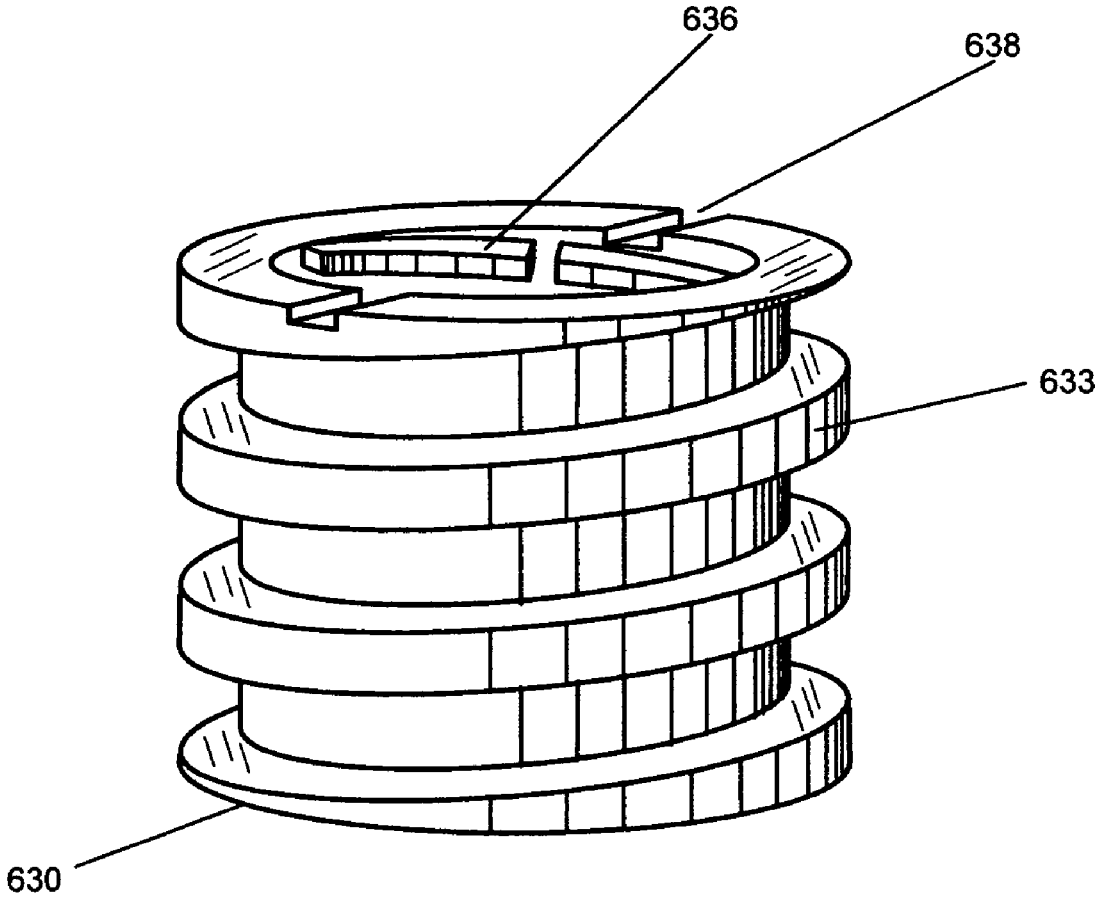

FIG. 40 shows an adaptor that will allow a 3-liter volumetric displacement device to use smaller bottles.

Figure 70:
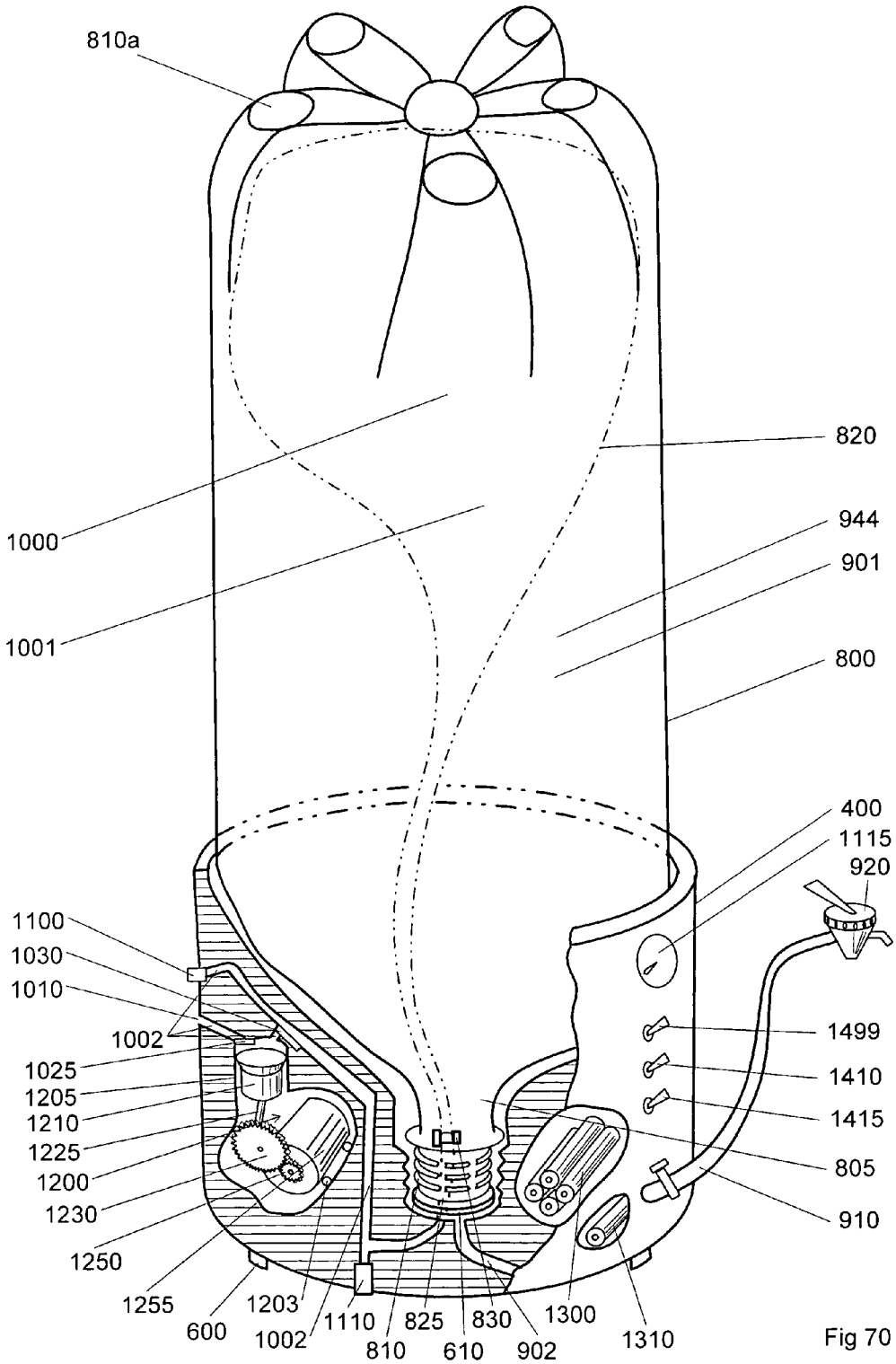

FIG. 70 shows an internal displacement partition embodiment.

Figure 80:
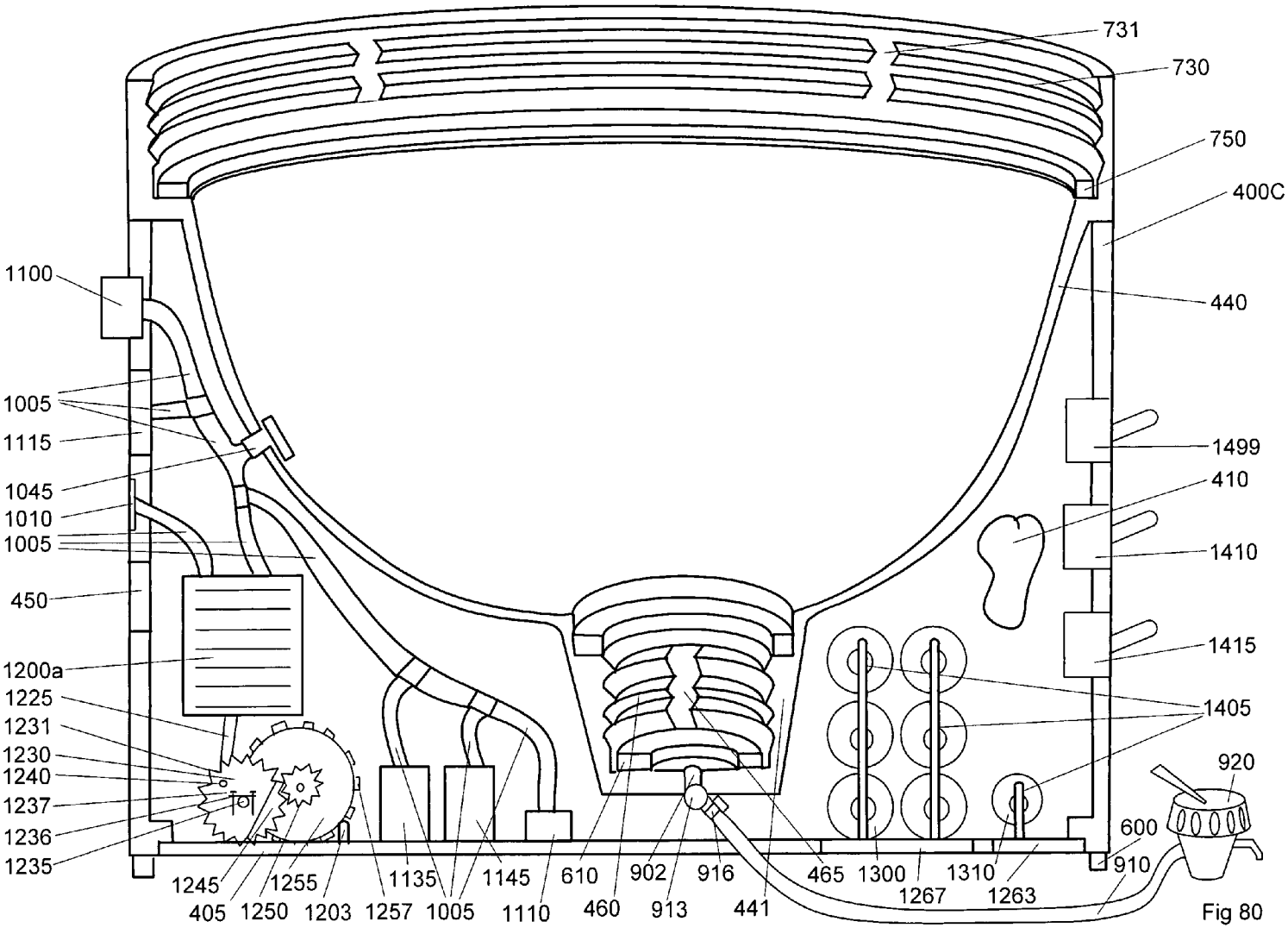

FIG. 80 shows a cross sectional view of a frame closure using hoses instead of passageways, and thin ovaloid closure lining.

Figure 80A:
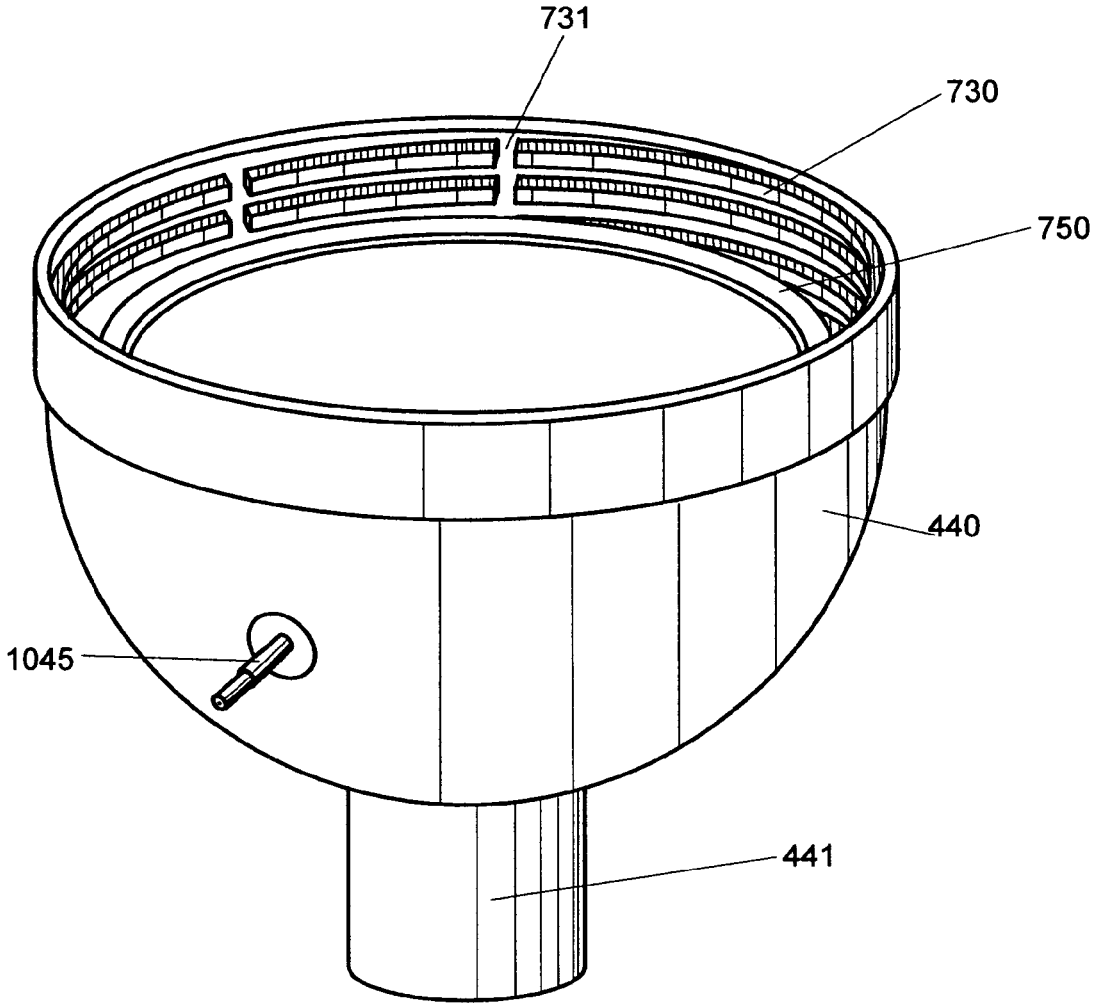

FIG. 80*a* shows a perspective view of an ovaloid frame closure lining.

Figure 85A:
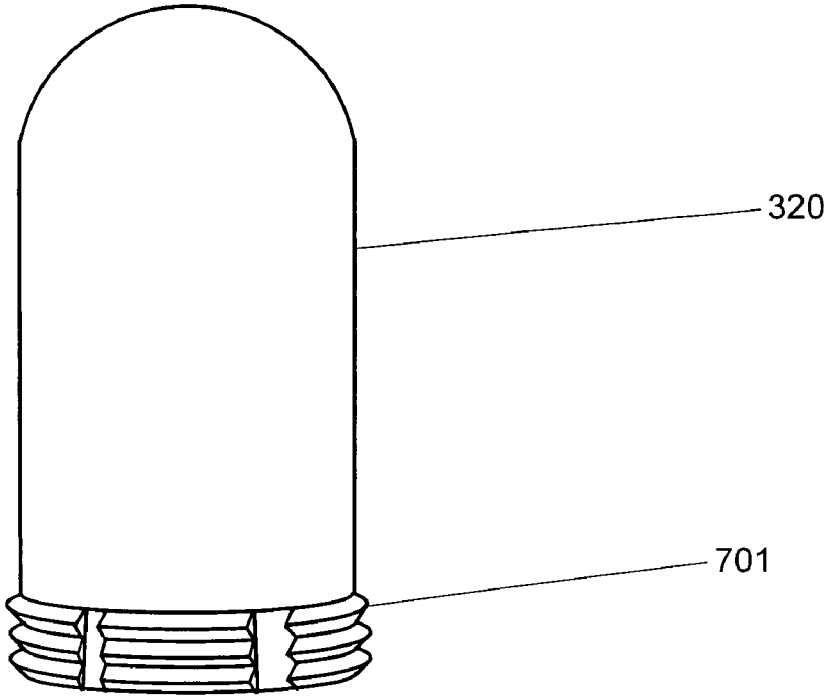

FIG. 85*a* shows a domed bell.

Figure 85B:
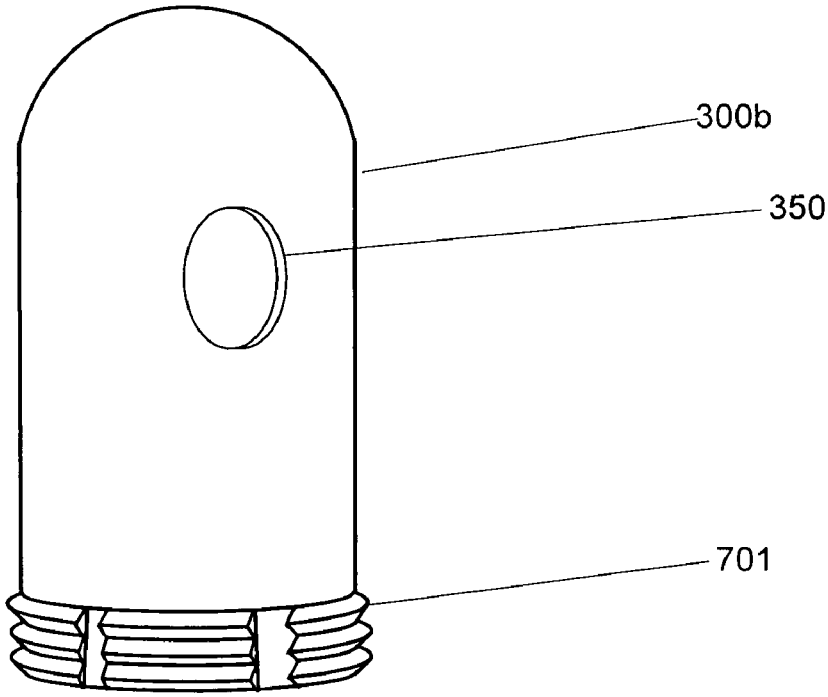

FIG. 85*b* shows a domed bell made of heavy plastic with a viewing port.

Figures 90A, 90B:
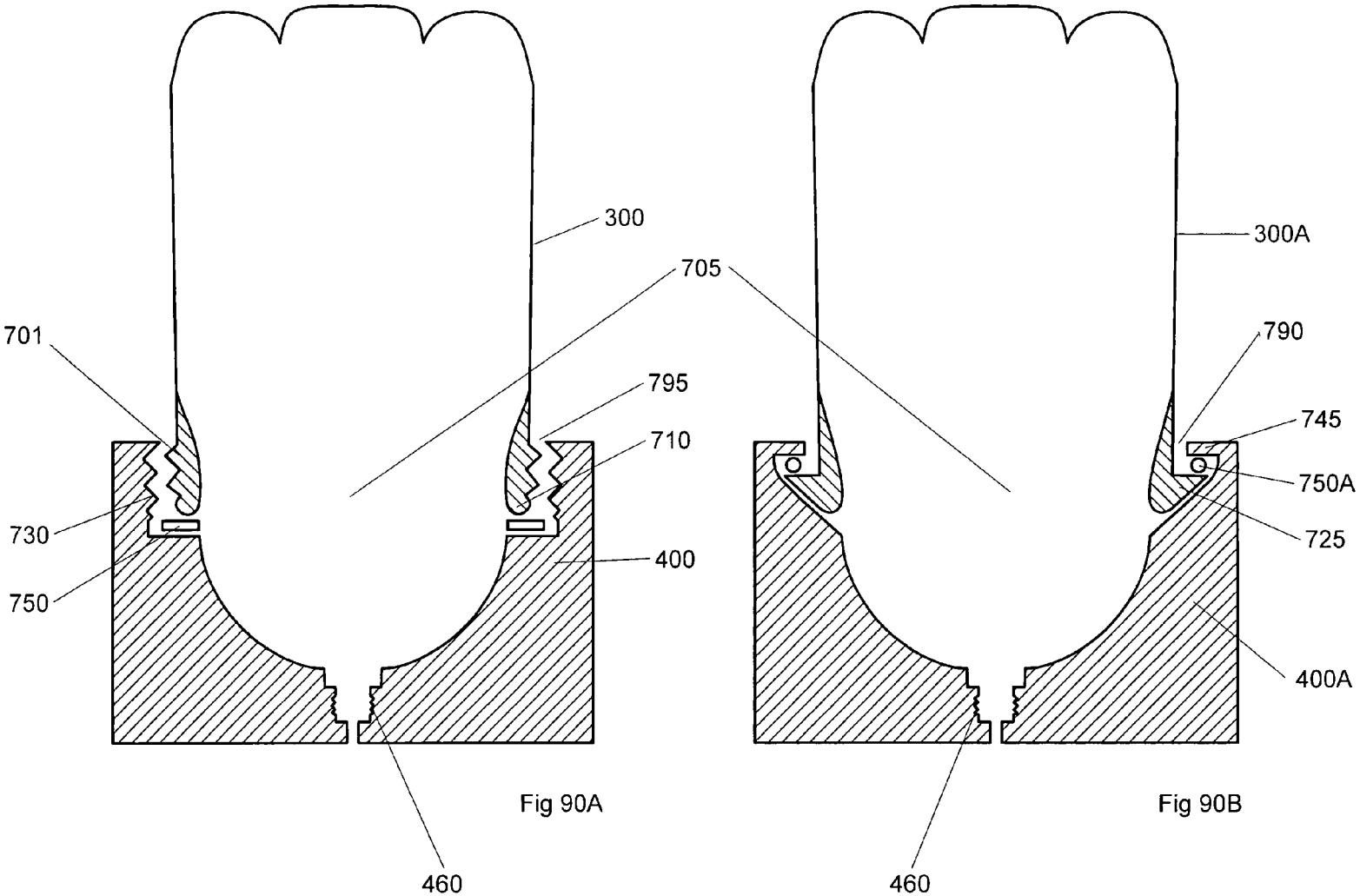

FIG. 90*a* shows a cross sectional view of the volumetric displacement device to demonstrate a threaded junction between bell and closure.

FIG. 90*b* shows a cross sectional view of the volumetric displacement device to demonstrate a snap fit junction between bell and closure.

Figure 90C:
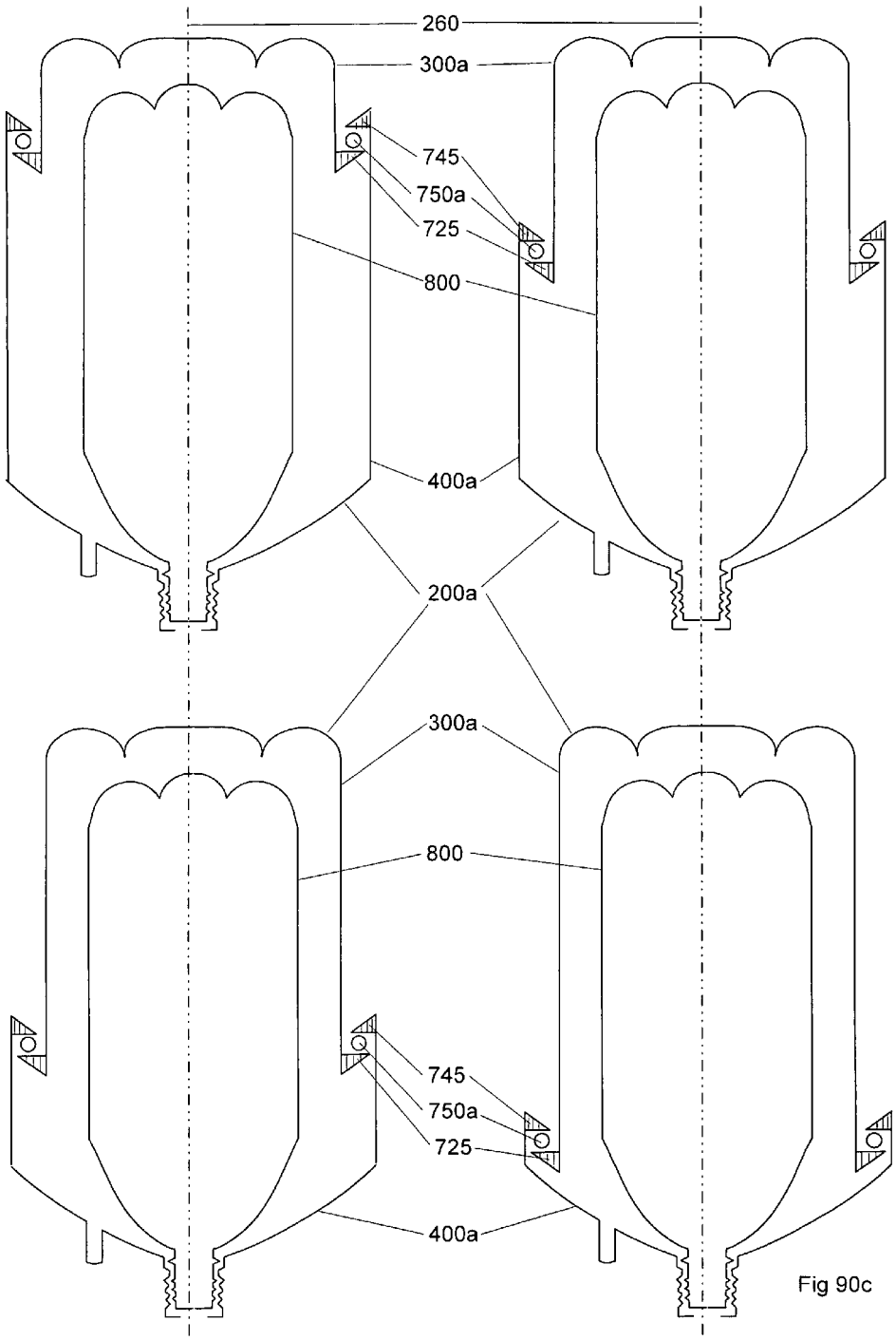
Figure 120:
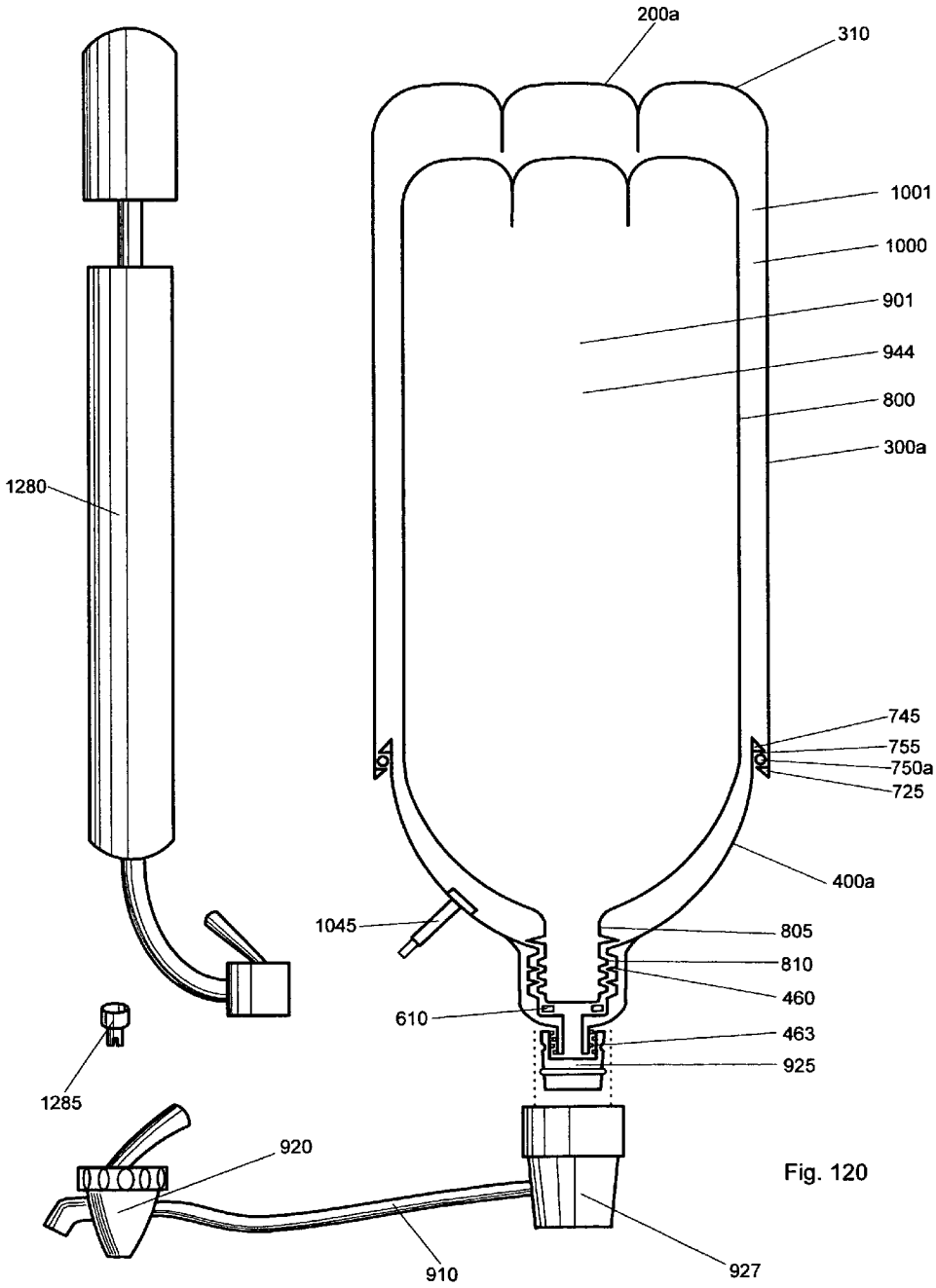

FIG. 90*c* shows a cross sectional view of the volumetric displacement device of FIG. 120 with junctions in positions translated along longitudinal axis.

FIGS. 110*a-g* shows how power could be delivered to a volumetric displacement device from the exterior of a conventional refrigerator to the interior of the refrigerator.

FIG. 120 shows a volumetric displacement device with a detachable usable material passageway and a detachable displacement matter passageway.

Figure 135:
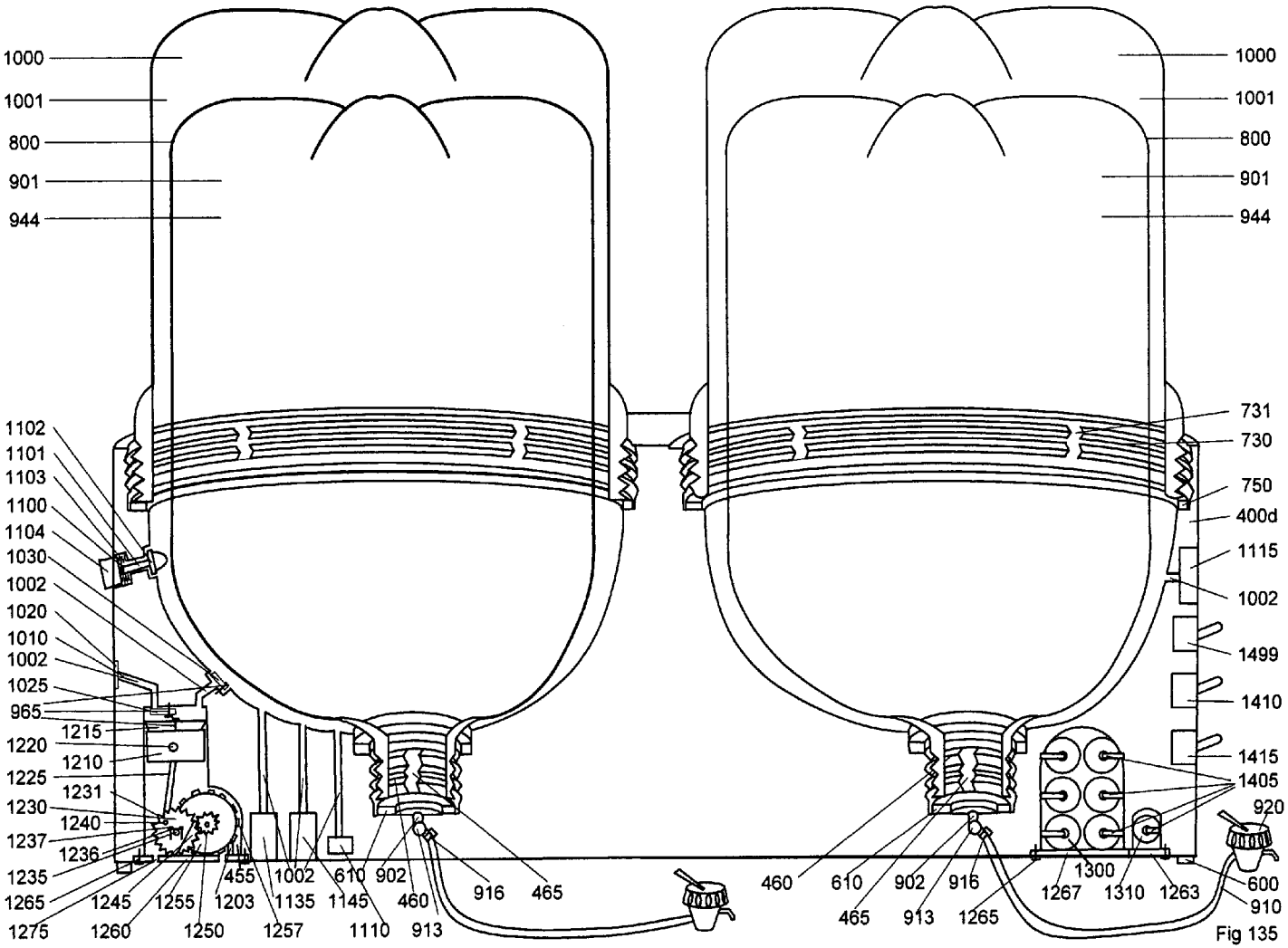

FIG. 135 FIG. 135 shows a volumetric displacement device with two bottles 800 and two bells.

Figure 100:
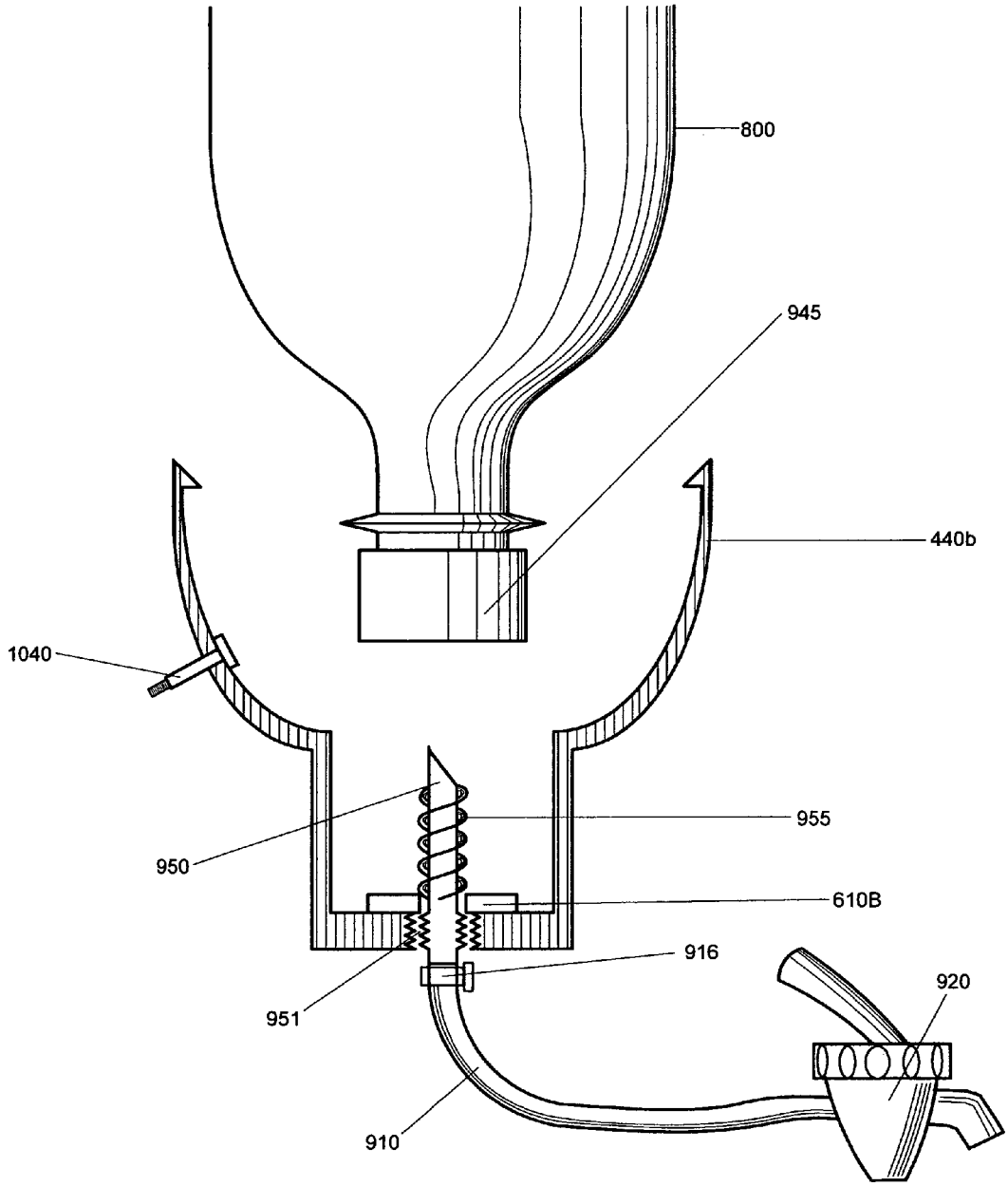

FIG. 100 shows a cap piercing adaption

Figure 140:
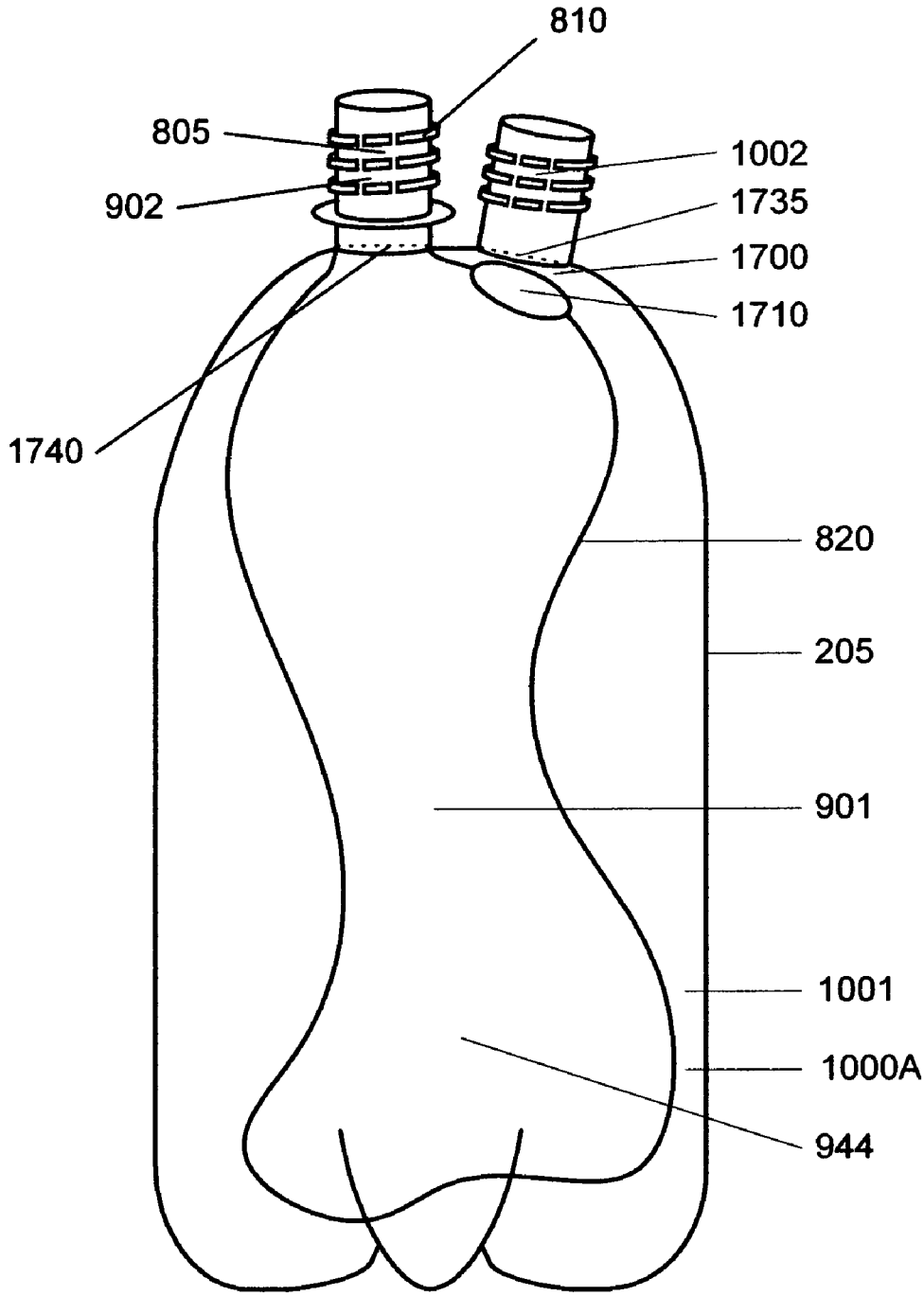

FIG. 140 shows a displacement partition valve.

REFERENCE NUMERALS TO DRAWINGS

Container 200
200 volumetric displacement device 200
200*a* volumetric displacement device 200*a*, quick fit model with snap fit junction.
200*i* volumetric displacement device 200*i*, internal displacement partition model.
200*p* cap piercing volumetric displacement device 200*p*, internal displacement partition model.
205 container 205, containment means Ovaloid {concept}
210 beach ball 210
220 tire inner tube 220, Torus, donut
230 cylindrical tank with hemispherical ends 230
240 tin can 240

Elb 250
250 ELB 250
260 container longitudinal axis 260
270 container plane A 270
280 container plane B 280

Bell 300
300 bell 300
300*a* bell 300*a*, snap fit bell
310 bell feet 310, conventional PET bottle bell feet 310
320 hemispherical bell 320
330 bell break line 330
340 bell safety plug 340
350 bell viewing port 350
360 solid block {multiple} 360

Closure 400
400 closure, solid closure 400
400*a* closure 400*a*, snap fit closure
400*a* closure 400*c*, frame closure
405 closure cover 405, frame closure cover
405 frame closure cover 405
410 closure insulation 410
440 closure lining 440, ovaloid frame closure lining
441 closure lining bottle neck thread housing 441
445 closure lining screws 445
450 closure viewing port 450
455 compressor vent groves 455
460 closure to bottle neck threads 460
463 closure to usable material quick fit valve threads 463
465 closure to bottle vent groves 465
470 closure grips 470
475 closure flat spot 475, neck horizontal rest Container Accessories 600
600 closure feet 600
610 closure to bottle neck seal 610
620 closure handle 620
630 3 to 2-liter adaptor 630
633 3 to 2-liter adaptor male threads 633
636 3 to 2-liter adaptor female threads 636
638 3 to 2-liter screw driver slot 638
640 displacement partition lock blade 640
643 displacement partition lock handle 643
646 displacement partition lock screw 646
650 displacement partition lock spring 650
653 displacement partition lock air purge valve 653
656 displacement partition lock air purge valve seal 656
660 Bell lock blade 660
663 Bell lock handle 663
666 Bell lock screw 666
670 Bell lock spring 670
673 Bell lock air purge valve 673
676 Bell lock air purge valve seal 676

Junction of Bell and Closure 700
701 bell to closure threads 701
702 bell junction vent groves 702
705 bell mouth 705, with 4 to 5 inch opening.
710 bell lip 710
725 bell snap lip 725
730 closure to bell threads 730
731 closure junction vent groves 731
735 frame closure to bell threads 735
745 closure snap lip 745
750 bell to closure seal 750, {pref, metal, clamp}
750*a* bell to closure snap seal 750*a*
755 seal grease 755
790 snap fit junction 790
795 thread fit junction 795

Displacement Partition 800
Bottle/Conventional PET Container
800 bottle 800, conventional PET soda bottle, flexible bottle
805 conventional bottle neck 805
810 conventional bottle neck threads 810
810*a* conventional bottle feet 810*a*

Interior Displacement Partition
820 Displacement partition 820
825 Displacement partition bottle pipe barb 825
830 Displacement partition clamp 830

Usable Material 900
901 usable material chamber 901
902 usable material passageway 902
905 usable material hose 905
906 hose clamp 906
910 usable material external hose 910
913 usable material hose barb 913
916 hose clamp 916
920 usable material valve 920, conventional carbonated beverage delivery valve nozzle
920*a* usable material valve {a} 920
920*b* bottom usable material delivery nozzle 920*b*
920*c* side usable material delivery nozzle 920*c*
925 UMP quick fit valve 925, {cornelious keg valve}
927 UMP quick fit connect 927, {cornelious keg style connector}
930 pickup tube 930
940 CO2 gas bubble 940
944 usable material 944, carbonated beverage, soda, beer
945 conventional bottle cap 945
950 cap piercing member 950
951 cap piercing member closure threads 951
955 cap piercing member cap threads 955
965 valve screws 965

Displacement Matter 1000
1000 displacement matter 1000, air
1000*w* displacement matter 1000*w*, air
1001 displacement matter chamber 1001
1002 displacement matter passageway 1002
1005 Displacement matter hose 1005
1010 air inlet 1010
1015 displacement matter bypass valve 1015
1020 air inlet filter screen 1020
1025 displacement matter intake valve 1025
1030 displacement matter compressor exhaust valve 1030
1035 displacement matter valve screw 1035
1040 displacement matter passageway quick fit valve 1040, compressor style quick connect
1045 displacement matter quick fit valve 1045 conventional tire valve
1085 tire valve depressor 1085

Displacement Matter Control 1100
1100 user pressure release assembly 1100
1101 user pressure release valve bolt 1101
1102 user pressure release valve seal 1102
1103 user pressure release valve spring 1103
1104 user pressure release valve button 1104
1110 safety pressure release valve 1110
1115 pressure gauge 1115
1117 pressure gauge needle 1117
1120 no pressure indicator
1121 delivery mode indicator
1123 save mode indicator
1126 rejuvenate mode indicator
1130 over pressure indicator
1135 displacement matter pressure switch 1135
1140 save mode pressure switch 1140
1145 rejuvenate mode pressure switch 1145

Compressor {Air, Gas} 1200
1200 compressor assembly 1200
1200*a* conventional compressor assembly 1200*a*
1203 compressor assembly shock absorber 1203
1205 cylinder wall 1205
1210 piston 1210
1215 piston seal, 1215 jakari style piston seal
1220 piston wrist pin 1220
1225 connecting rod 1225
1230 flywheel 1230
1231 flywheel gear 1231
1235 flywheel axel 1235
1236 flywheel axel retainer member 1236
1237 flywheel axel retainer member screw 1237
1240 flywheel pin 1240
1245 flywheel balance 1245
1250 motor gear 1250
1255 motor, electric motor, energy to mechanical energy conversion means 1255
1257 cooling fan 1257
1260 compressor cover 1260
1263 displacement matter battery cover 1263
1265 cover screws 1265
1267 compressor battery cover 1267
1275 compressor cover air vents 1275
hand tire pump 1280, conventional hand operated tire pump Stored Energy Means 1300
1300 compressor battery 1300
1310 displacement matter battery 1310, potential energy source, compressor battery
1325 Versapak batteries 1325

Electronics 1400
1400 on/off power switch 1499
1405 battery contacts 1405
1410 save/rejuvenate mode toggle switch 1410
1415 delivery mode power switch 1415
1420 save mode power switch 1420
1425 rejuvenate mode power switch 1425
1430 wire 1430, electrical conductor wire
1435 voltage controller 1435, 12V electric drill voltage control Other 1500

Environment
1505 table top
1510 user's hand

Postmix Delivery
1520 conventional soda gun, fountain
1530 post mix syrup container Refrigerator Power Access
1600 thru refrigerator conductor 1600
1600*a* thru refrigerator ribbon conductor 1600*a*
1610 electrical conductor 1610
1615 electrical insulator 1615
1617 ribbon connector 1617
1620 refrigerator through tube exterior 1620
1621 refrigerator through tube interior 1621
1622 refrigerator through tube threads 1622
1625 through tube insulation 1625
1630 through tube nut 1630
1635 battery charger 1635
1640 refrigerator clips 1640
1650 refrigerator body 1650
1655 refrigerator door gasket 1655
1660 refrigerator door 1660
1665 volumetric displacement device rack 1665
1670 refrigerator light 1670
1672 refrigerator light socket 1672
1673 refrigerator light socket adaptor 1673
1675 rack battery charger 1675
1680 auxiliary door switch 1680

1420 112 V electric plug, conventional 112 V electric socket plug 1420

1460 battery recharge to VDD contacts 1460

1465 volumetric displacement device to battery charger contacts 1465

Displacement Partition Valve

1700 displacement partition valve 1700

1710 tough spot, thick spot 1710

1715 preform thick spot 1715

1720 affixed spot 1720

1730 manufacturing rod 1730

1735 displacement matter chamber screen, grid 1735

1740 usable material screen, grid 1740

DETAILED DESCRIPTION

Terminology

Volumetric Displacement Device

Volumetric Displacement Device

Is generally defined as a specialized holding apparatus for generally fluid matter that in general has two or more containment partitions. The outer partition forms a container that for the purposes of the apparatus described here in, will generally have a fixed internal volume. Located within the container will be found the second containment partition, generally of a flexible material, and referred to as the displacement partition. The containment partition within a containment partition structure or Displacement partition within a container forms two distinct chambers. A volumetric displacement device has a means for bidirectional transfer of displacement matter between the environment and one of the chambers that chamber by definition becoming the Displacement matter chamber, and a means for bidirectional transfer of usable material between the other chamber and the environment that chamber by definition becoming the usable material chamber.

In general, the volumetric displacement device allows a portion of the usable material to be removed from the volumetric displacement device, and another portion of Displacement matter to be put into the volumetric displacement device. In this manner the volumetric displacement device can generally be kept in a full fill state where the entire volume of the container is substantially filled with the combination of displacement matter in the displacement matter chamber and usable material in the usable material chamber.

Variable Fill State Device, Soda Saver

Generally refers to embodiment of the invention described in this application, and are versions of Volumetric displacement devices.

Container

The outer containment means of a volumetric displacement device.

Pressure Chamber

A container with a means for bidirectional transfer of material between itself and the environment and where the internal pressure of the container can be set to a pressure different from that of the environment external to the chamber.

Environment

Generally refers to the universe external to the container, typically atmospheric air although other environments are possible.

Contents

Generally refers to the sum of all matter in the container including usable material, displacement matter, and the displacement partition.

Immiscible

Generally refers to two or more materials, matters which for the most part do not mix and do not significantly react with each other.

Rigid

Generally refers to matter, material used either as contents or in structure, that does not deform.

Flexible

Generally refers to matter, material used either as contents or in structure, that will bend, but that does not stretch appreciably. A flexible container has relevance to the volumetric displacement device because it has a maximum internal volume which, unless the container is deformed by an external force, will remain constant. For example, a one liter plastic soda bottle will not attain an internal volume greater then one liter regardless of the internal pressure applied to it, within the pressure limits that deform the plastic, although squeezing the bottle could diminish the volume. A toothpaste tube when squeezed has a diminished volume, which is what causes the paste to be dispensed.

Elastic

Generally refers to matter, material either as contents or in structure, that will change size under tension, stress or pressure. Containers made of elastic material will not have a fixed volume.

Non-Elastic

Generally refers to matter, material that will not stretch, and can be either rigid or flexible.

Non-rigid Solid

Generally refers to matter, material in the solid phase that is broken up, such as grains, toasted cereals, potato chips, spices, crushed ice or powders.

Multiple Components

Generally refers to matter, material that is made up of two or more different matters or materials, either in the same physical state or in different physical states, those states being liquid, gas, and solid.

Effervescent Liquid

Generally refers to a liquid that has a gas, typically CO2, dissolved in it.

Gas Impermeable

Generally refers to material, typically forming the displacement partition, which generally can not be penetrated by gas, or that slows the transfer of gas to a degree from one side of the material to the other side of the material. A gas impermeable partition serves as a barrier to the movement of gas across that partition.

Metering

Generally refers to the process of measuring out a specific amount of material.

Bi-directional Transfer

To transfer in a Bi-directional Manner generally refers to moving material from one location to another in either direction. Bi-directional transfer of usable material between container and environment would allow for both putting usable material into a container and taking it out of a container.

Valved Flow Control

Generally refers to the ability to variably regulate the flow of material through a point, such control being exemplified generally by the use of a valve, tap, or faucet.

Directional Flow Control

Refers to the ability to direct the flow of a material through material casings such as pipes, tubes or fluid reservoirs which are generally external to the container. "Directional flow control" devices generally direct the flow of material as input or output to the displacement matter chamber or the usable material chamber by physically connecting, directly or indirectly, to the container.

Environmentally Sensitive

Generally refers to usable material or environment that benefits from the condition of the usable material being isolated from the environment, which can be the atmosphere for example, either because the environment is damaged by contact with the usable material, or the usable material is damaged by contact with the environment. The environment can be other baths such as water, or space. By way of illustration, volatile toxic chemicals pollute our atmosphere and are said to be "environmentally sensitive". Air sensitive usable material can be damaged by exposure to air in the atmosphere and thus the air sensitive usable material is also said to be "environmentally sensitive".

Usable Material

The material that is being preserved and dispensed. Frequently this will be a carbonated beverage such as Soda or Beer, but can include and carbonated beverage or other fluid matter. Generally refers to the typically valuable contents of the container that are generally usable and consumed.

Usable Material Chamber

Generally refers to the region within the container that contains the usable material.

Usable Material Passageway

A passageway that is used to conduct usable material from one place to another.

Usable Material Valve, Faucet, Nozzle

A valve that restricts the flow of usable material in one or both directions in a usable material passageway.

Displacement Matter

Generally refers to matter that is added to the contents of the container for the purpose of altering the characteristics of the container's fill state, generally in such a manner so as to not contaminate the usable material.

Displacement Matter Chamber

Generally refers to the region within the container that contains the displacement matter.

Displacement Matter Passageway Displacement Matter Passageway

A passageway that is used to conduct displacement matter from one place to another.

Displacement Matter Valve

A valve that restricts the flow of displacement matter in one or both directions in a displacement matter passageway.

Displacement Partition

Generally refers to a partition that physically separates the container into regions, one that contains the displacement matter, and one that contains the usable material, hereby referred to as the displacement matter chamber and the usable material chamber, respectively. "Mobile" refers to the displacement partition that can move relative to the container. Such motion generally could cause a change in the volume of the displacement matter chamber and the usable material chamber, while the overall volume of the container remained constant.

Save Mode

Where the pressure in the volumetric displacement device is enough to preserve the carbonation in the carbonated beverage. Typically 37 psi or above for soda and 10 psi for beer.

Delivery Mode

Where the pressure in the volumetric displacement device is enough to drive the usable material from the volumetric displacement device, but not enough to damage a carbonated beverage as it exits the volumetric displacement device. Typically 15 inches of water is used as the pressure.

Rejuvenate Mode.

Where the pressure in the volumetric displacement device is significantly higher than that of save mode. Typically 50 psi for soda and 20 psi for beer. This extra pressure is used to drive free CO2 in the bottle head space back into the beverage. Rejuvenation can be hastened with jostling, jogging, vibrating or shaking the volumetric displacement device in some manner.

External Displacement Matter Chamber

Figure 5A:
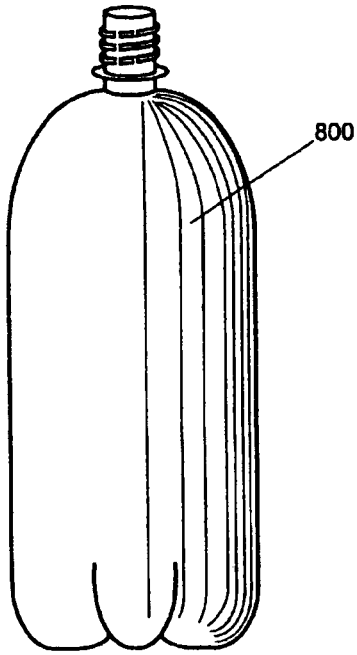
Figure 5B:
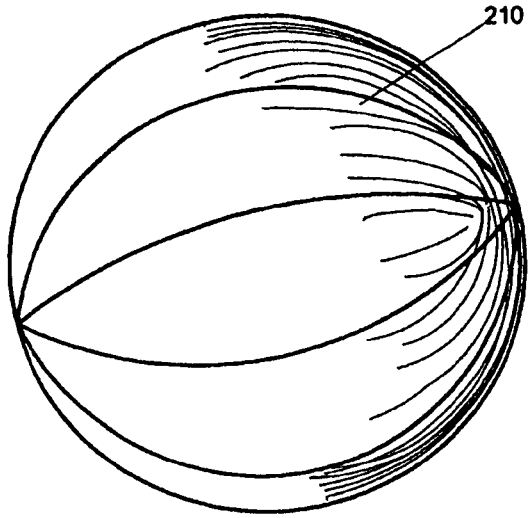
Figure 5C:
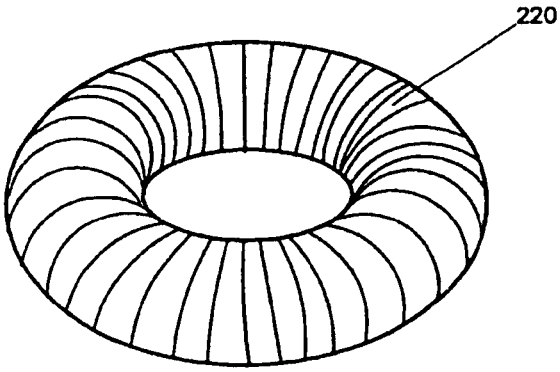
Figure 5D:
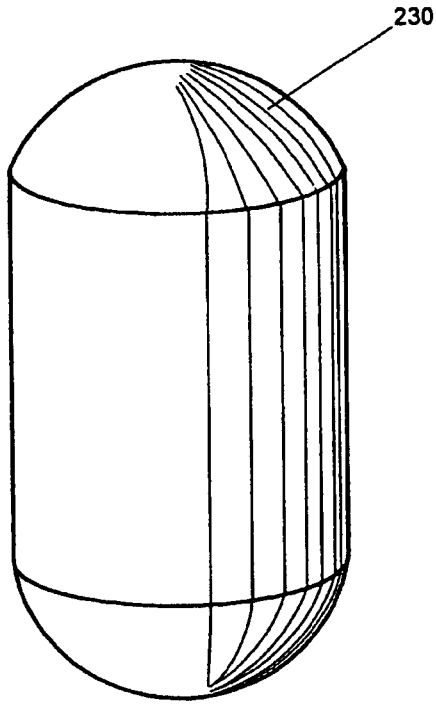
Figure 5E:
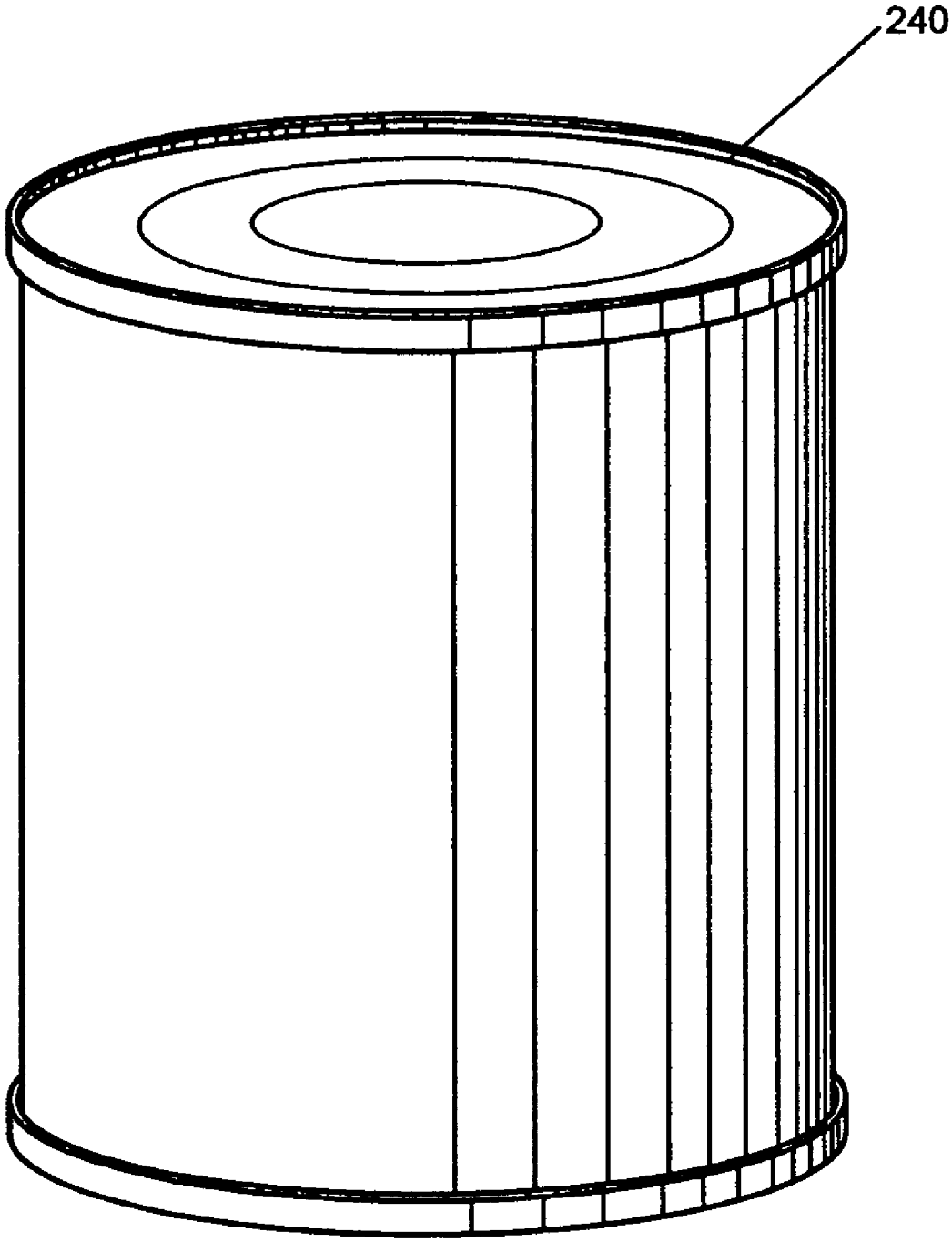

A volumetric displacement device where the usable material chamber 901 is inside the displacement matter chamber. A conventional bottle in a compression chamber is a typical external displacement matter chamber Internal Displacement Matter Chamber A volumetric displacement device where the displacement matter chamber is inside the usable material chamber 901. A bag in a conventional bottle is a typical internal displacement matter chamber application Ovaloid An ovaloid shape, Is defined as a shape assumed by a hollow object, that object if formed from a relatively flexible material, that is relatively inelastic, when said hollowness is sealed to allow the hollowness to be pressurized, and pressurized sufficiently to blow out the object to the point where it will not reasonably deform further, but will instead rupture under sufficient pressure. FIGS. 5*a-e* shows some ovaloid and non-ovaloid shapes. A conventional soda bottle, FIG. 5*a* is in an ovaloid shape in that it is relatively thin, yet internal pressure relative to the environment will not cause it to deform. This is a very complex shape with feet and all that was developed specifically for carbonated beverages, and specifically to be non-expanding when made of thin material. The feet are particularly well designed to prevent expansion although there is some liberty with thicker plastic in the feet. A round beach ball or sphere, FIG. 5*b* is an optimal ovaloid shape. A tire inner tube or torus FIG. 5*c* is a donut shape which by this definition is ovaloid. A hollow cylinder r filled with air, with hemispherical ends on it, similar to what a conventional soda bottle FIG. 5*d* is, is relatively ovaloid. A hollow cylinder with flat bottoms on the container, such as a common food storage can FIG. 5*e*, is not ovaloid because, if the internal air pressure in the cylinder is raised and the material of the container is relatively thin, the flat bottom and top of the container will deform as they push and move in an outward direction. Internal pressure deforms this shape unacceptably and will cause it to fail in the described application. The non-ovaloid deformed container does move towards becoming an ovaloid shape when internal pressure is applied. If the material of the top and bottom of the flat ended cylinder is relatively brittle, under sufficient pressure it will bend and break at pressure far below what an ovaloid container of similar construction would generally tolerate. Thin containers when pressurized move towards ovaloid shapes due to the simple laws of physics. It has not been recognized that the outer container for a volumetric displacement device, {especially ones that contain a displacement partition which in turn has the usable material residing generally with in the displacement partition, and especially those displacement partition that function as bottles}, should be an ovaloid shape. It has not been recognized, that, incorporating an ovaloid shape to the container, allows an extremely thin and light weight outer container to be achieved. With this ovaloid shape, the container can be produced with relatively the same characteristics as conventional thin walled containers, especially, for example, PET containers. This means that the costs, features, clarity, thinness, weight, safety and other functionality commonly associated with what are generally considered disposable containers, can now be associated with the container for a volumetric displacement device. Common blow molding techniques, and stretch blow molding techniques can be used to make the container parts. Techniques and materials used to make conventional PET containers are applicable to the container construction. Other plastics and materials apply as well.

An ovaloid shape is a hollow walled container form that is not substantially deformable by internal pressurization and is non-expanding if the material composing the shape is inelastic and even if the material composing the shape is flexible. In short, a relatively thin walled, flexible, hollow ovaloid object will generally not deform when internal pressure is applied to that object, and the thin walls of the object will not move outwardly relative to the center of the object.

ELB: External Lip to Body Space.

Essentially, a common bottle, such as a PET soda bottle, has a cylindrical body of relatively fixed radius, and a neck extension leading to the opening of the bottle, topped with a lip. The cylindrical space above the body of the bottle, outside the bottle and neck, and below the lip, and within a radius that is equal to the radius of body of the bottle. This is the space outside the bottle, that would generally be taken up in the refrigerator, because of the neck, but is somewhat unusable for other things besides the container. More formally, given a conventional PET bottle/container sitting on a table with cylindrical walls, said container having a plane C that runs through it's base, that coincides with the top surface of the table it is sitting on, and a plane B through the highest point on the bottle that is still at the widest radius of the body Plane B being parallel to Plane C and a Plain A which runs through the uppermost lip of the neck opening of the container, plain A being parallel to Plane B and C, The ELB resides between Plane A and B. Furthermore, the outer walls of the main body of the container form a cylinder. This cylinder is of the same radius as the body. If the walls of the cylinder were extended in an upward direction, perpendicular to Plane A, B and C, until the walls met plane A, Then the outermost portion of the imaginary extended wall between Plane A and Plane B Defines the outer edge of the cylindrical ELB space. Any space within or part of the container is also removed from the defined ELB space. Thus the cylindrical ELB space has a radius that is equal to the radius of the container body.

ELB or container neck lip to container body space is defined, which for a conventional PET carbonated soft drink container of year 2004, would be that space that lies generally between a neck lip plane, which is a plane drawn through the bottle neck lip, that plane being parallel to the container bottom plane that runs roughly tangentially to the container at the points the container would touch a table top when that container is sitting upright on that table top, and a top of container fat body plane that runs roughly parallel to the neck lip plane, runs also through the widest part of the container in that parallel orientation, and is the plane satisfying these requirements that is farthermost from the container bottom plane, and said container neck lip to container body space further delineated by the cylinder that is perpendicular to the neck lip plane, the container fat body plane, and the container body plane, and that is the same diameter as the fattest part of the container body, and centered such that the longitudinal axis of the cylinder lies on the longitudinal axis of the container, both axis being perpendicular to the container neck plane, the container fat body plane, and the container bottom plane whereby, the container takes little more height and width that a conventional bottle container when stored in a refrigerator for example.

Free CO2

CO2 that is not in the beverage, having been released from the beverage or added to the head space by a CO2 auxiliary system.

Container

Generally, a containment device for displacement matter 1000 or usable material 944 or a combination of both, that surrounds a flexible displacement partition, so that pressure my be applied to the contents within. Generally refers to the outer storage vessel of a volumetric displacement device that holds contents.

Bottle

A bottle for the purpose of the document generally refers to a conventional flexible plastic container such as a conventional PET CSD container. A bottle is a container that has the property that it can stand up on a table when open without disgorging it's contents, and it can be poured from. Conventional beverage bottles have caps. {note that for the purpose of this definition, container is used as it is in the beverage industry. Otherwise container has a slightly different meaning as defined above.

Fill State

Generally refers to the nature of the container's contents, generally in terms of the amount of material and/or matter the container holds. For example a container may be thought of as full, partially full, or empty. The word generally is used because scientifically speaking, the container is always full of something. For example, when describing a container containing half air and half water by volume, the container is said to be, and behaves as if, it were half full. Filling a container, in this instance, generally means to replace something not wanted in the container, that came into the container from the environment (air for example), with something that is more desirable, such as more usable material or displacement matter.

Full Fill State

A container that is full in any combination by the sum of the displacement matter 1000 and the usable material 944 contained within. The container generally does not contain unpressured air.

Generally refers to a condition of a container where the void of the container is devoid of unwanted matter. In general, the container is said to have a "full fill state" when for practical purposes, the container is full of either usable material or displacement matter, the latter which may be contained in a displacement matter chamber within the container. In general, the container will hold no more at this point.

Bi-directional Transfer

Transferred in a Bi-directional Manner" generally refers to moving material from one location to another in either direction. Bi-directional transfer of usable material between container and environment would allow for both putting usable material into a container and taking it out of a container.

Longitudinal Axis of Container

Figure 10:
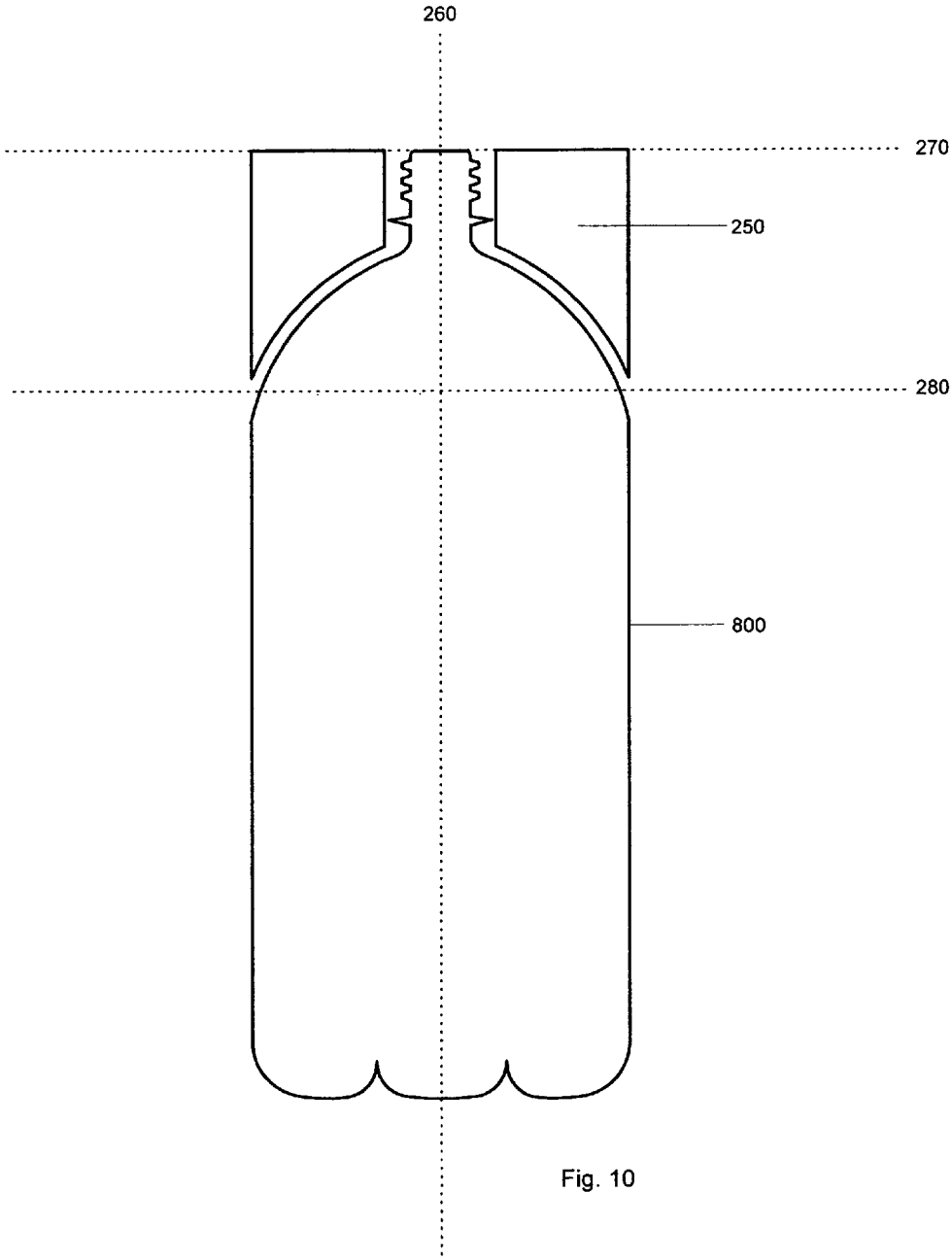
FIG. 10 shows a series of figures which portray the concept of ELB.

When the container is generally cylindrical, and considering a conventional bottle sitting on a table in upright position, there is a line running perpendicular to the table, and through the center of the container from it's base, through the center of it's neck opening. The walls of a conventional PET container would be equidistant from this longitudinal axis. See FIG. 10.

Quick Release

Generally refers to standard line coupling techniques for pressure fittings. Can be screw together, can be conventional "quick release" air fitting adapters commonly found on compressed air lines, can be tire valve type arrangements where the compressor hose presses on a fitting as found on various automobile or bicycle tires. Can be the type of release typically found in soda and beer applications, twist on, or to Cornelious kegs. Can be invented to suit this application more.

Neck Down Position refers to a volumetric displacement device that is in such a position that the opening to the displacement partition facing down. If the displacement partition where a bottle, then its neck would be pointing down. See FIG. 30*a*.

Neck Horizontal Position refers to a volumetric displacement device that is in such a position that the opening to the displacement partition facing sideways. If the displacement partition where a bottle, then its neck would be pointing sideways. See FIG. 30*b*.

Neck up Position refers to a volumetric displacement device that is in such a position that the opening to the displacement partition facing up. If the displacement partition where a bottle, then its neck would be pointing up. See FIG. 30*c*.

Rejuvenate

The process of putting CO2 gas back into soda that has gone flat. Generally, free CO2 is used.

Power Source

Generally a source of energy for the compressor. It may be electricity, an electric battery, alternate electricity source, compressed gas, stored mechanical energy as in a compressed spring, human muscle power, or any other means of supplying energy.

Preferred Embodiment

External Displacement Matter Chamber, Battery Powered Volumetric Displacement Device with an Integrated Closure and Compressor Assembly, an Ovaloid Container, Separate Delivery and Save Modes and Bell Feet Overview of Preferred Volumetric Displacement Device The PREFERRED embodiment of a volumetric displacement device 200 is depicted in FIGS. 1, 15, 15*a*, 20, 20*a*, 30*a-c*, 40. An ovaloid container 205, containment means is shown and is most generally comprised of a bell 300 and a closure 400. This container can serve as a pressure chamber. This container is used to house a variety of parts needed for the volumetric displacement device 200 to function, and a bottle 800, flexible bottle, of usable material 944, Soda, Beer or other carbonated beverage. A flexible bell 300 is formed from PET plastic in much the same manner as a conventional PET carbonated beverage bottle is formed. The bell has an opening large enough to accommodate either a 2 or a 3 liter bottle full of beverage, bell, having an opening diameter generally equal to or larger than 4 inches or 5 inches respectively. Cast into the shape are bell feet 310, formed in shapes that are consistent in form and function to those found on a conventional PET bottle used to contain soft drinks. These feet can be used to stand the container in a neck up position. Formed into the plastic of the bell are thin spots in a line or scores that create a bell break line 330, and a bell safety plug 340. These weakened areas allow breakage of the container in a controlled fashion in the event of over pressurization. The bell has formed at its opening, bell to closure threads 701, which are used to secure the bell to a closure 400, which in the PREFERRED embodiment is a solid block of plastic with portions removed to form cavities and passageways in the block to house parts and material needed to make the volumetric displacement device work.

The closure has formed into it's plastic closure to bell threads 730, which allows the closure to attach to the bell 300. The bell terminates with a bell lip 710. Sandwiched between the closure 400 and the bell lip 710 is a bell to closure seal 750 formed from a rubber like material which can compress to accomplish the tight seal. Seal grease 755 is employed on both sides of the bell to closure seal 750, to make a better seal. The closure also has bottle to neck threads 460 formed which allows the closure to securely attach to the bottle 800. To accomplish sealing between bottle and closure, a closure to bottle neck seal 610, of a rubbery compressible material is used. Seal grease 755, is employed on both sides of the closure to bottle neck seal 610, to make a better seal.

Secured with a bonding agent to the bottom of the closure 400 are closure feet 600, made of a rubbery compressible material. Side closure feet 600*s* are secured to the side of the closure 400 so that the closure will rest in the neck horizontal position as well.

Inside the container 205 screwed into the closure is a bottle 800, in this case a conventional PET soda bottle with a conventional bottle neck 805, and conventional bottle neck threads 810. The bottle 800 contains usable material 944, which can be carbonated beverage, soda, beer or any fluid matter.

Usable material 944 exits the volumetric displacement device 200 through a usable material passageway 902, bored or formed by other means in the closure 400. A usable material external hose 910, runs between the usable material passageway 902 and a usable material valve 920, which is a conventional carbonated beverage delivery valve nozzle.

Figure 1:
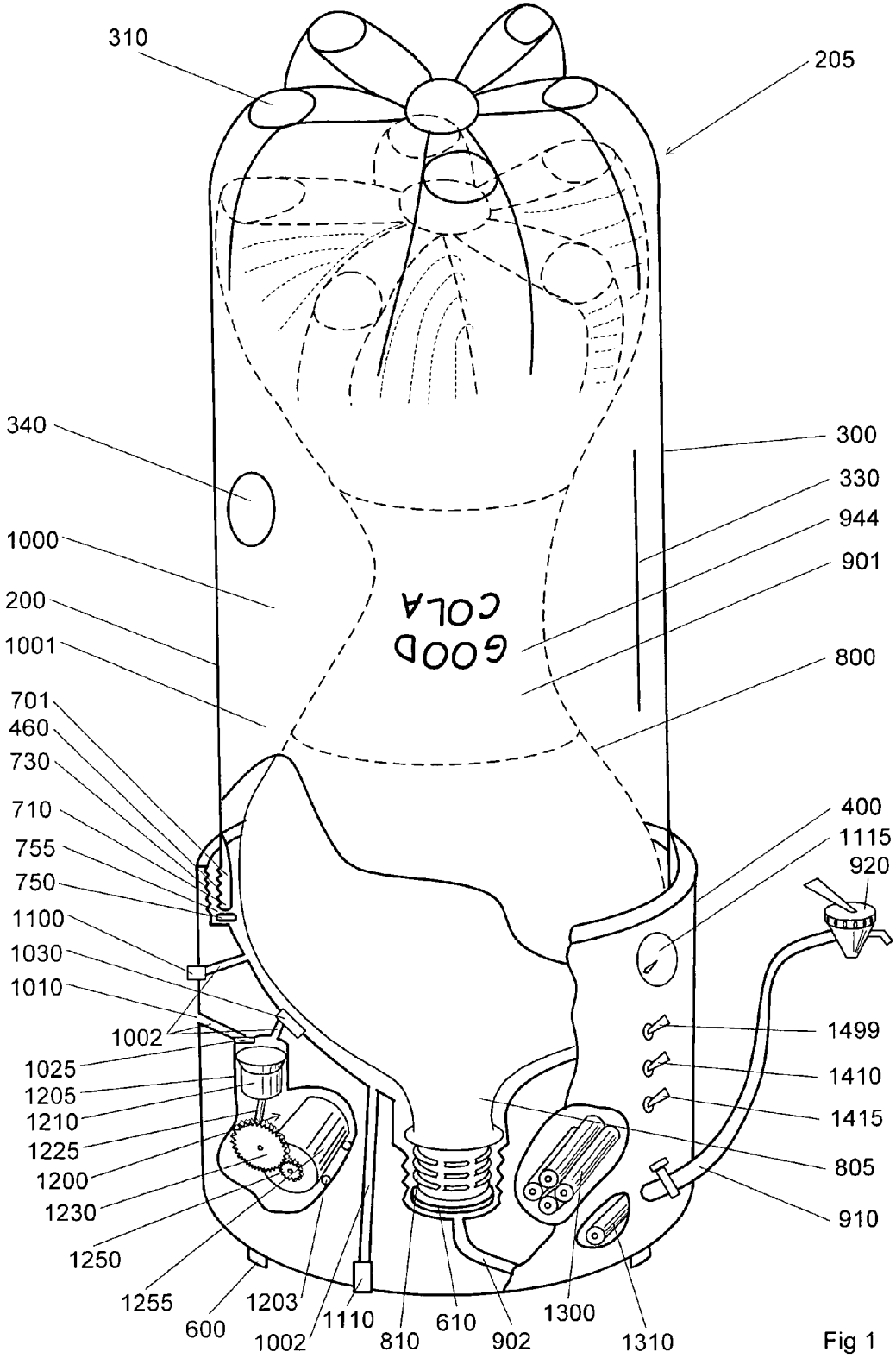

A displacement matter chamber 1001, is delineated that lies within the container 205 and outside the bottle 800. Connecting the displacement matter chamber with the environment and the various components that need to communicate with the displacement matter chamber 1001 is the displacement matter passageway 1002. At one end of the displacement matter passageway is an air inlet 1010, which leads to a displacement matter intake valve 1025. After displacement matter 1000, air goes through the displacement matter intake valve 1025, it goes into the compressor cylinder 1205. The air then follows the placement matter passageway 1002 to the displacement matter compressor exhaust valve 1030, and into the displacement matter chamber 1001. Various portions of the displacement matter passageway lead to various components including the user pressure release assembly 1100, which allows a user to press a button and release then internal pressure in the displacement matter chamber 1001, a safety pressure release valve 1110, which prevents the volumetric displacement device from over pressurizing, a pressure gauge 1115, which allows the user of the volumetric displacement device to read it's internal pressure, and a series of pressure switches which will be discussed latter, but not show in FIG. 1. Parts of the compressor assembly 1200, are shown in FIG. 1, which is separated from the closure 400 with a series of compressor assembly shock absorbers 1203. The compressor assembly 1200 is relatively standard having a piston 1210, a connecting rod 1225, a flywheel 1230, motor gear 1250, motor 1255, electric motor, energy to mechanical energy conversion means, and a compressor battery 1300, delivery mode battery, electrical battery, potential energy source, to drive the compressor assembly 1200 to pump displacement matter 1000 into the displacement matter chamber 1001, in a conventional manner.

The PREFERRED embodiment has a second electrical battery displacement matter battery 1310, which serves to drive the motor 1255 at a relatively slow speed so as to deliver soda from the volumetric displacement device at low pressure so not to damage it. The volumetric displacement device depicted also has an on/off power switch 1499, which turns power on and off from the compressor battery 1300 to the motor 1255. It also has a save/rejuvenate mode toggle switch 1410, which toggles the volumetric displacement device between save mode and rejuvenate mode. The volumetric displacement device depicted has a delivery mode power switch 1415, which turns power on and off from the delivery mode battery 1310 to the motor 1255. The circuitry that connects these electrical devices will be discussed in a later section that deals with the electronics of the volumetric displacement device.

Overview of Closure Assembly

FIG. 15 shows a more detailed cut away view of the closure 400 used in the PREFERRED embodiment. Compressor vent groves 455, spaces are left between the closure 400 and the compressor assembly 1200, to allow air flow to cool the compressor. A cooling fan 1257 is attached to the shaft of the motor 1255 which drives air through the Compressor vent groves 455. Closure to bottle vent groves 465 are cut into the closure to bottle neck threads 460, which allow compressor air to escape the displacement matter chamber 1001 when the bell 300 is unscrewed from the closure 400. Threads are cut into the closure 400 to attach a usable material hose barb 913 formed of metal which holds the end of the usable material external hose 910. A usable material valve 920, conventional carbonated beverage delivery valve nozzle, is attached to the other end of the usable material external hose 910 and both ends of the hose are secured with hose clamps 916.

Details of the valves that control the displacement matter 1000 flow can be more clearly seen on FIG. 5. The displacement matter intake valve 1025 and the displacement matter compressor exhaust valve 1030 are formed of a flexible material such as silicone rubber, but can also be a thin member of springy metal as in a conventional reed valve on a conventional compressor. The are each secured to the Closure 400 at a valve seat with a valve screw 1035. The air inlet 1010 of the displacement matter passageway 1002 is covered with an air inlet filter screen 1020 composed in standard manner of foam. Also can be seen the details of the user pressure release assembly 1100, composed of a user pressure release valve bolt 1101, a user pressure release valve seal 1102, a user pressure release valve spring 1103, and a user pressure release valve button 1104

A displacement matter passageway 1002 is formed in the closure 400 for a save mode pressure switch 1135 and for a rejuvenate mode pressure switch 1145. These pressure sensing switches are set to values that represent the pressures desired for save mode and rejuvenate mode. For example, a save mode or 28 PSI can be selected, while a rejuvenate mode of 45 might be used for soda. A beer setting might be much lower, for example 13 psi for save mode and 25 psi for rejuvenate mode. Such pressure sensing switches are available such as the MPL 600 series from MPL at www.pressure-switch.com. Available with threads these standard switches are threaded into the ends of displacement matter partition's. Wiring is complete as shown latter in the electronic schematic section of this document.

Individual parts of the compressor are shown in FIG. 5. A piston seal 1215 sits atop the piston 1210 secured with a piston seal screw 1215. This seal is similar to that found in a conventional bicycle hand pump, being conical in nature, and formed from silicon rubber. The cone spreads on the compression stroke to form a tight seal with the cylinder wall 1205. A piston wrist pin 1220 formed from metal connects the connecting rod 1225 formed from metal to the piston 1210 which is formed of plastic. The other end of the wrist pin 1220 connects to the flywheel 1230 formed from metal at the flywheel pin 1240. The flywheel 1230 is mounted on a flywheel axel 1235 formed of metal about which the flywheel rotates. The flywheel axel is secured to the closure 400 with a flywheel axel retainer member 1236 of plastic and secured with a flywheel axel retainer member screw 1237. A flywheel balance 1245, of metal is formed as part of the flywheel 1230 to balance the flywheel 1230 as it turns. The edges of the flywheel 1230 have gear teeth which engage the teeth of the motor gear 1250 which is attached to the shaft of the motor 1255 all in conventional fashion.

A compressor cover 1260 holds the compressor motor in place and is secured with cover screws 1265. Holes are formed in the compressor cover 1260 to form compressor cover air vents. In like manner a delivery mode battery cover 1263 secures the delivery mode battery 1310 and a compressor battery cover secures the compressor battery 1300.

Battery contacts 1405 are secured to the closure 400. Finally, electrical conductor wire 1430 is run in passageways formed in the closure 400 to make appropriate electrical connections as depicted in the electronic schematic sections of this document. FIG. 15*a*, shows an external view of the closure with bell 300 and bottle 800 installed. Attached to closure 400 is a closure handle 620. Side feet 600*s* let the volumetric displacement device 200 rest on its side.

Volumetric Displacement Device

The PREFERRED embodiment of the volumetric displacement device utilizes the conventional PET bottle as a cartridge. The customer purchases the bottle of beverage at the store, places it into the volumetric displacement device in the appropriate manner, and is served consistently good carbonated beverage.

The unit has functionality that is similar to that described by Litto U.S. Pat. No. 6,220,311. Terms and concepts developed by Litto in U.S. Pat. No. 6,220,311 apply to this document. The physical theories and operation that govern the volumetric displacement device of U.S. Pat. No. 6,220,311 apply to this patent application as well.

In this model, the convention PET bottle is pressed into the container by the conventional compressor, a 2 or 3 liter PET bottle capable of holding, storing, pouring beverage is crushed under pressure.

The compressor batteries, attachments and necessary valves, faucet, safety and convenience options will be contained in a convenient unit that is portable in this embodiment, and will adapt. These functions are not trivial. They are carefully designed into the containers. It is attempted to make the size and weight of the volumetric displacement device as small as possible.

It is beneficial to view the inner workings of the volumetric displacement device. Looking into the bell gives the user an idea as to how much beverage is left, allows for checking correct operation, and for trouble shooting as well as the esthetic advantages. The user doesn't have to wonder what's going on inside the container. It makes for easier operation. The user can check to see if a gas bubble has developed.

Container

By making the interior of the container approximately the same size and shape as that of a conventional PET bottle, the amount of air that is needed to be pumped in is maintained at a minimum. This conserves energy, makes the system run the minimum amount of time, keeps where down and makes the system run most efficiently. Such an ovaloid shaped container, assuming near the shape and size of a conventional PET container and holding said PET container, would have a minimum of air to pump into the container, as the PET container would take up the maximum space in the container.

A container with a top that is shaped approximately the same shape as the bottom of a bottle, having generally and approximately and roughly an ovaloid shape wherein a conventional ovaloid bottle top would fit with a minimum of air space between the bottle and the closure top whereby, the shape in the closure thus formed is optimal for holding compression by a thin layer of material without distortion, is formed with the minimum amount of material yet achieves maximum strength for a maximum strength to material ratio, and keeps the amount of air that is pumped into the displacement matter chamber 1001 at a minimum.

A container which is ovaloid is made with substantially less plastic for cost savings, be safer from having less plastic, have less pressurized airspace in it, will more mimic the shape of a conventional PET soda container, and leave more room for parts in the ELB.

In addition, if the thin walled ovaloid container were to rupture, from excessive internal pressure, and that container wall is made of a tough plastic such as PET, it would be expected that there would not be any heavy pieces to fly after the rupture, as the container is made of light weight thin material sheeting, in much the same way a conventional PET container would be expected to form.

Thus the ovaloid container is shaped such that if the material forming said container is non-elastic and flexible, increasing pressure within the container will not change the shape of the container.

Thus a container is formed which is ovaloid whereby the container can be made with substantially less plastic for cost savings, be safer from having less plastic, have less pressurized airspace in it, more mimic the shape of a conventional PET soda bottle.

The container has a closure with a surface adjacent to the bottle that is shaped approximately the same shape as the top of a bottle, having generally and approximately and roughly an ovaloid shape wherein a conventional ovaloid bottle top would fit with a minimum of air space between the bottle and the closure top whereby, the shape in the closure thus formed is optimal for holding compression by a thin layer of material without distortion, can be made with the minimum amount of material yet achieve maximum strength for a maximum strength to material ratio, and keep the amount of air that is pumped into the displacement matter chamber 1001 at a minimum.

The container, composed of the bell with closure can be of clear materials, such as clear plastic, acrylic, lexan or materials used for bullet proof windows, glass, plastic or metal or any other strong material capable of withstanding pressure and holding air.

A combined container closure and bell shape this is approximately the size and shape of a conventional container is formed.

Bell

The material of the PREFERRED bell is clear, transparent, thin, light weight, non elastic and flexible The volumetric displacement device is constructed with a clear BELL so that container can be observed for correct operation, and to estimate amount left, and for Esthetics.

PET material creates a bell that is relatively flexible.

First a preform is cast in PET. The preform is heated, is stretched longitudinally to align the plastic molecules, and then stretched radially as the preform is stretch blow molded to the final shape.

The bell is made of material that will not shatter as it would not break so as to have pieces that would not break off.

The bell is made of light weight strong plastics for clear safe light weight solutions.

The bell is formed of relatively light weight, thin plastic, as might be found in a conventional PET bottle, and formed as a conventional PET container is formed. Feet are formed in the plastic of the bell, so that the container can be stood on the bell, to put it into the neck up position, in the same manner as a conventional PET bottle.

Bell container is inexpensive and disposable, and the mouth of the bell is wide enough to accept conventional PET bottle.

Burst Control

Break Line

The function of the bell break line or bell safety plug is to break out upon excess pressure, so that the entire volumetric displacement device will not catastrophically break up in an uncontrolled manner. This represents a means of making a bell with a controlled breaking point in it.

There may also be safety blow out and break areas designed into the bell container to have it blow, crack, separate break or release in a predictable safe manner. The break line, rip panel, rip line in bell, score is formed in the bell. A weak, thin, outlined plug, cast into container blows at earlier pressure than container. The break line cast into bell container, breaks and releases pressure before bell container catastrophically destructs.

The bell may be simply scored with a sharp tool. Alternatively a thin spot in preform, use of hot bars to press into the bell after blow molding, score bell with hot barb, or a bump in the blow mold form would form the break line. Slightly misaligned molds of preform, or final blow would accomplish same function. Press hot bars into walls, both sides to thin it.

Bell Safety

An example of a light weight plastic containment device is found in a conventional PET soda bottle. As this bell is constructed with the same technology as a conventional PET soda bottle, it would be expected to be as save as the well tested conventional PET soda container. Another aspect of the safety of this volumetric displacement device is that the exceptionally light weight bell that would not be a danger if it flew off under pressure. Since it is large and light weight, air resistance would not allow it to fly very far. Even if it struck something, it is large and light so it is unlikely to cause much damage. Effectively, another pet bottle on outside, has nearly the same safety considerations as the original interior container.

Closure

The interior of the closure device assumes an ovaloid shape. The closure seals the bell thus completing the ovaloid container. The ovaloid shape prevents the closure from deforming unacceptably under relatively high pressure. It closes the conventional PET bottle. The closure serves to blow compressed air into the displacement matter chamber 1001. The closure will serve as a faucet or have a faucet attached to dispense beverage.

This closure body has a flat side which allows the entire volumetric displacement device to sit in a the Neck Horizontal position without rolling.

The closure will serve as a stand for the bottle in that the closure once attached can work in any orientation. Thus the bottle screwed into the closure, may be turned over so the closure serves as a base. The container my also be set on it's side, so that the flat part of the closure will serve as a stand for the container preventing it from rolling.

ELB

The closure is constructed to be the size and shape of the ELB. In this manner the battery, motor, compressor, displacement matter passageway 1002, usable material passageway 902, valves, pressure gauge, pressure sensor switches and other controls housed within the closure lie substantially within the ELB space. This allows the volumetric displacement device to take up only slightly more space in their refrigerator than a conventional soda bottle would.

A volumetric displacement device is constructed fitting a conventional bottle where some, many, any or all of the group of {compressor, usable material valve, displacement matter valve, usable material passageway 902, displacement matter passageway 1002, electromechanical converter, power supply, compressor piston, compressor exhaust valve, compressor intake valve} lies predominately in the ELB space.

Feet

The closure of the volumetric displacement device serves as a stand. Feet to stand the volumetric displacement device on are made of a rubber like material that is won't slip on a table and cushion the volumetric displacement device. Feet are also put onto the flat side spot of the closure, so that the volumetric displacement device can be set into the neck horizontal position without the volumetric displacement device rolling on a flat surface.

Integrated, Once Piece, Compressor Turns Relative

The closure forms a one piece assembly integrated with all the parts of the compressor, battery, motor, displacement matter passageway 1002, usable material passageway 902, valves, pressure gauge, pressure sensor switches, usable material valve 920, controls and other parts shown in FIG. 15. This forms an integrated closure assembly. This entire integrated closure assembly rotates relative to the bottle as the bottle is sealed when the integrated closure assembly is screwed onto the bottle. The entire integrated closure assembly also rotates relative to the bell when the closure is screwed onto the bell.

The bottle can be placed on a table while the compressor revolves around it as the closure is attached to the bottle or conventional PET bottle.

Usable Material Passageway.

Velcro tabs are attached to the bell and to the usable material hose as a means to keep the hose from flopping about.

This hose is flexible but springy material that pops back to position. As the hose is bent to a position, it springs back to the storage position.

Usable Material Passageway Variation.

A conventional soda regulator can be used to the pressure the soda comes out at to control foaming. Such a regulator would potentially be a part of the usable material passageway 902.

Increasing the diameter of the usable material passageway 902 will allow lower pressure to be used when delivering soda. This will reduce foaming problem. The larger the diameter of the usable material passageway 902 that faster the delivery.

With a large usable material passageway 902, this usable material chamber 901 environment pressure differential could be allowed to become very small, even as small as a fraction of a single psi unit. Very little pressure is needed to remove beverage. As the output pressure, that is the pressure differential between usable material 944 and environment becomes very small, the carbonation of the drink remains very high as it is poured.

Compressor

The compressor is powered by an electric motor, a device that converts electricity into mechanical energy.

Compressor Variation

A conventional piston pump is employed here, but other type of air pumps are possible to use such as perhaps a diaphragm pump.

Battery

The volumetric displacement device converts potential or stored energy into pressurized displacement matter 1000 for the purpose of preserving and dispensing carbonated beverages that have been partially dispensed.

Storing energy in the battery is used to applying pressure to displacement matter 1000, which is converted to a compressed air block residing within the displacement matter chamber 1001.

The battery is a means for storing energy and storing electricity energy. The electrical motor is means for converting stored energy to mechanical energy. The compressor converts mechanical energy into compressed air which is used to preserve carbonated beverages.

Battery Types

Batteries used can be conventional Rechargeable batteries such as nickel cadmium, nickel metal hydride, lithium or non-rechargeable types such as alkaline, lithium, lead acid or carbon zinc batteries or any other suitable source of electricity.

Replaceable Rechargeable

Power can be obtained from interchangeable power unit

Replaceable rechargeable batteries, battery packs, that can be charge independent of closure, detached, and then inserted fully charged as the other dead battery, battery pack, batteries are removed for charging. Batteries can be put into and taken out of battery holders.

A Black and Decker Versapak {trademark} battery has rubber ends which can serve as feet for the volumetric displacement device. These feet remove themselves as battery is removed, and are replaced as the charged Versapak battery is replaced.

Batteries are replaceable, snap in, so batteries can be charged in charger outside refrigerator, then swapped for discharge batteries in volumetric displacement device, bell model.

Module Concepts

The entire closure may be placed on a charger. In this way a stored energy module is interchangeable closures.

Power in this embodiment is stored in rechargeable batteries. With rechargeable batteries, the closure and container assembly can be removed from the battery charging unit and is thus portable without the need to maintain a power connection to the electricity system of a house for example at 110-120 volts AC.

Alternative Power Supplies

Fuel cells could be employed to supply power.

An optional car battery plug, or a AC to DC converter plugged directly to wall outlet so that the volumetric displacement device can run without batteries.

Delivery Mode Batteries

Batteries can be used in such a way as to diminish voltage, for delivery mode. That is, if 8 batteries pump up to make a save mode, then using only one battery at 1.2 volts for example, might be enough to make the thing run in delivery mode. This eliminates need for low pressure switch, voltage reduction electronic circuitry.

Conventional AC converters.

Battery Changing

User will see pressure gauge is low, and pump is off. User may see a bubble of CO2 gas that can't be pushed back into the beverage. The user will replace discharged batteries with charged batteries, pump up the displacement matter chamber 1001 pressure, optionally shake the volumetric displacement device it to put CO2 back in beverage, optionally place the volumetric displacement device into Rejuvenate mode, and the volumetric displacement device will pump good carbonated beverage again.

Bottle

A conventional PET bottle is used as the storage device for carbonated beverage, (CB). This has a neck size of approximately ⅞ inch inside diameter and ⅛ inch outside diameter including threads for 16 oz, 20 oz, 24 oz, 1 liter, 2 liter PET plastic CSD containers (carbonated soft drink) and 1 3/16 to 1 7/32 inside diameter and 1½ inch approximate outside diameter w/threads for 3 liter bottles.

This displacement partition that is capable of also containing pressurized material in excess of 50 psi and not rupturing.

The described volumetric displacement device empties and compresses a flexible bottle that can be stood up, poured from, and capped.

The described volumetric displacement device can function as a carbonated beverage preservation system that accepts a conventional carbonated beverage container, having a neck with threads, wall in excess of 2 mils in thickness and which by itself is capable of supporting itself and which may be poured from so that the container may be used in the manner of a conventional bottle as well as being plugged into the described volumetric displacement device The described volumetric displacement device can protect carbonated beverages in a bottle which at once serves as containment device that can be handled, stood up, and poured from in a conventional manner, and at the same time empties and protects the contents as it is managed by the volumetric displacement device.

The displacement partition, bottle is capable of with standing a pressure differential between inside and outside of 50 psi.

The described volumetric displacement device is capable of incorporating a flexible displacement partition that is rigid enough to be picked up with one hand and poured from while at the same time said displacement partition remains relatively undeformed in the manner that a conventional bottle might be picked up and poured from.

The described volumetric displacement device is capable of incorporating a displacement partition that would resist the puncture of a sharp object with the same resistance that a conventional carbonated beverage conventional PET bottle would.

The described volumetric displacement device is capable of incorporating a flexible displacement partition that is capable of holding fluid and sitting on a table with closure removed and not disgorging contents, while installed in the volumetric displacement device the displacement partition will be deformable and disgorge contents upon having pressure placed upon it.

The described volumetric displacement device is capable of incorporating a flexible displacement partition, that displacement partition by itself can be used as a means to transport usable material 944 without a the volumetric displacement device and not be damaged while the displacement partition containment device is in a full fill state, even if the contents of the displacement partition is a fully carbonated beverage.

The described volumetric displacement device is capable of incorporating a flexible displacement partition with thickness greater than 4 ml.

The described volumetric displacement device is capable of incorporating a flexible displacement partition which is at once a bottle and at the same time a collapsible container Displacement Matter Passageway Valves The displacement matter compressor exhaust valve 1030 serves two functions. One, it is a conventional exhaust valve that prevents higher pressure air from reentering the compressor cylinder. In the PREFERRED volumetric displacement device the valve also prevents compressed air from exiting the displacement matter chamber 1001. This valve is easily washed in the describe volumetric displacement device. It can be unscrewed for cleaning.

The safety pressure release valve 1110 is set to a safe value, just under the rejuvenation mode pressure that gives the volumetric displacement device added safety. Should the pressure go to high for any reason, it is safely vented to the environment.

Mode

Reasoning, Non-Violent Carbonated Beverage Delivery

A big problem that is immediately encountered with a volumetric displacement device for saving carbonated beverages or soda, is that removing the soda at high pressure destroys the carbonation. Blasting soda out at 30 psi is so violent, that no carbonation remains in the beverage after it is dispensed into a drinking glass. The problem is the soda is destroyed coming out of nozzle, very flat and very foamy.

The described volumetric displacement device solves this problem by delivering or dispensing the soda at a lower pressure. The volumetric displacement device has a means for controlling foaming whereby pressure is reduced in the container before usable material valve 920 opens, and then increasing the pressure again after the usable material valve 920 is closed The pressure in the volumetric displacement device is dropped by pressing the user pressure release button 1104. At low pressure, the soda flows out quietly out the usable material valve 920, thus leaving the soda in good shape. After delivery of the drink, the nozzle valve is closed, and the pressure reintroduced to the volumetric displacement device with the battery operated pump. The Soda can now be saved.

This introduces a delivery mode and save mode. This introduces delivery pressure and a save pressure. The container can be vibrated in the rejuvenate mode. A method and apparatus for reducing pressure in volumetric displacement device, then removing material is advanced. Material is removed via a tapping means.

Save Mode

Only a little more pressure is needed in the container 205, than is needed in a conventional carbonated beverage bottle. If the conventional carbonated beverage develops a max Pressure of 37 psi for example, then 37 psi in the container 205 is enough to drive all the CO2 back into beverage at the equilibrium.

Delivery Mode

A means for dropping pressure before exit of soda as a means of reducing carbonation loose do to violence of soda exit is advanced.

A good pressure for delivery might is around 15 inches of water.

Two methods of maintaining a low delivery pressure are suggested. One is to have a pressure switch that operates at the delivery pressure, employed to maintain a low pressure flow. When a circuit is activated, this switch runs the compressor to provide a low pressure output, in a manner consistent with conventional compressor pressure electronic control.

Another method that could be employed, is to activate a circuit that reduces the voltage to the compressor motor, thereby running it very slowly. By adjusting the voltage applied to the motor, the motor can push out a slow steady volume of soda that can be adjusted to be approximately that of say 15 inches of water.

Delivery Mode Via Pressure Sensing

An alternate way to garner a delivery mode is to measures the pressure differential between the usable material chamber and the environment.

FIG. 20 shows an optional delivery mode pressure switch 1135 which can be put into the circuit to measure the pressure in the usable material passageway 902. A pressure of 15 inches of water is used in the PREFERRED embodiment, but this pressure is adjusted depending on the usable material external hose size. Without this pressure sensor, the user activates the delivery mode switch 1415 manually.

The delivery mode can be activated potentially in a number of ways. A switch can be pressed by user. This switch initiates the loss of pressure. A valve can be opened as a result of the action of the switch, or by opening the valve manually. If electronic valves are used, the pressing of the usable material valve 920 would first activate a pressure release feature to shift to delivery mode. After the pressure is reduced to a sufficient level, the usable material valve 920 can be opened, either by switch, or by user permission. Such permission can be granted by a light, for example, which lights up when the system is in suitable delivery mode. Lights, position of toggle switch, LED indicators, can signal whether the volumetric displacement device is in save mode, delivery mode, rejuvenate mode or what ever other modes are needed.

Two relays control Delivery and Save mode. The Delivery relay is Set to a couple pounds and is on a circuit that closes the compressor activating circuit. Another relays set to Save Mode Pressure, also activates the compressor circuit. A user toggle allows the save mode circuit to activate in save mode, and disables it in Delivery Mode.

Measure a pressure differential between environment and usable material 944 pressure. Keep this to a constant during delivery. Will yield greater pressure in displacement matter chamber 1001 as container provides resistance. Pressure is more accurately read in usable material chamber 901, as this would subtract the effect of the resistance of the bottle wall, however, reading the pressure in the displacement matter chamber 1001 is less messy as air pressure, not soda pressure is read. Another circuit is to be built for maintaining the save mode pressure. Various companies are contacted to find an adjustable pressure switch in the range of approximately 30 to 50 PSI. The goal is to find a relatively small, inexpensive switch with a reasonable dead zone so that he motor will not be burned out. Such a unit is described by MPL, model 808. This pressure switch can be configured in the area needed according to the sales representative. They can be purchase in bulk for as low as $4 list, and a sample can be procured for $25. A 3 amp switch, produced by Honeywell is incorporated. The pressure can be adjusted to Plus or Minus 10 to 15 percent. It is decided that a clear bell will be produced, pressure controlled manually, until it can be determined exactly what pressures to have the MPL unit configured to. A conventional air pressure gauge reading from 0 to 60 lbs is procured.

Delivery Mode Via Voltage Regulation

This method has many advantages. First, it does not need another pressure sensor. A slow steady relatively quite pump might be better than running the compressor at full speed intermittently as pressure is needed and then not needed cyclically as a standard compressor operates. Since a slow pump speed is needed anyway, cost could be reduced by not having a Low Pressure switch.

One simple way to accomplish this is to use a second battery set at lower voltage. In fact, a single 1.5 volt battery worked well in running the compressor at a very slow speed. By engaging that circuit as show the compressor is run slowly.

Running the compressor slowly reduces vibration of the volumetric displacement device. Reducing vibration in delivery mode increases the quality of delivered soda as there is less foaming and less loss of carbonation.

Rejuvenate Mode

During times when the volumetric displacement device is at low pressure, or is warmed, CO2 can come out of the beverage. It will form a bubble of free CO2 on the top of the beverage. This bubble can be forced back into the beverage. It will go back into the beverage in delivery mode, but a higher pressure will hasten the process, so rejuvenate mode is introduced.

The PREFERRED embodiment of the volumetric displacement device has a soda rejuvenate mode. In this mode, the pressure within the container holding the container is brought to sufficient pressure to rejuvenate or recarbonate the soda, that is by driving that gas bubble that has formed back into the soda. The process is speeded up by a vibration, tapping, jogging, shaking, sonic waves of the system that will enable jostle the soda thereby driving the soda back into the drink faster. Vibrations and mechanism such as those found in the Sonicare toothbrush might hasten soda going back into solution. Note that systems developed will be such that free CO2 never leaves the container. Gas bubble will always above exit point of container when system is designed as stated elsewhere in this disclosure.

One thing that has to be considered is the effect of vibration of the pump knocking carbonation out of the beverage. Vibration speeds the process of equilibration. Therefore, if the container is under pressure, Vibration speeds the process of equilibration. Therefore, if the container is under pressure, vibration will cause the beverage to be carbonated to the internal pressure of the container. If CO2 comes out of the beverage, then increasing the pressure and vibrating the container will drive the gas bubble back into the beverage.

For example, a beverage is carbonated to 2.7 atmospheres. Since the original beverage contained in the original bottle held a specific amount of CO2 gas, a certain pressure will drive all the free CO2 gas in the bottle back into the beverage. In the neck down position, for example, no free CO2 can escape the bottle. Thus there will always be enough CO2 left in the bottle to fully rejuvenate the soda.

It is noted that the save mode and recharge mode can be merged into one mode. The save mode can be any pressure point that is greater than the PSI of conventional soda. Thus, the save mode pressure need not be say, 35 psi, but could any higher pressure such as 40 or 50 or even 100 psi, for example. These higher pressures would be more efficient at keeping carbonation in the soda.

Vibrations will be put into the volumetric displacement device do vibrate, jostle, shake, stir up, bang on, hit or otherwise agitate the soda, so that under pressure, free CO2 will move back into the soda at an accelerated rate. By running the pump, releasing a slight bit of pressure and running the pump again cyclically, a vibration mode is introduced.

As an example, soda at 2.7 ATM is procured. Some soda is dispensed with the volumetric displacement device. A CO2 gas head space forms. Pressure is brought up to 3 atm, in the volumetric displacement device. The container equilibrates over time or with vibration. The CO2 is reabsorbed by the beverage. The pressure is reduced to 2.7 ATM again. The raising of the pressure will cause the CO2 to go back into the beverage faster.

If the beverage comes out a little flat at first, the remaining beverage will have the opportunity to be fully carbonated, or more, because the CO2 gas has not been lost to the environment. As pressure rises above 37 psi, CO2 will be equilibrated/vibrated back into the beverage.

At 37 psi or above, again, vibration drives the CO2 gas bubble back into the beverage.

The user should take care that a CO2 gas bubble never forms by putting pressure in the volumetric displacement device and shacking if necessary. This will prevent flat soda coming out and later the bubble going back into the drink to over carbonate it.

If the bell pressure need never go above 37 psi, there will never be over carbonation.

It is possible to use the compressor to make a vibration cycle after pressure is attained, to vibrate any free CO2 gas back into the beverage, however, if the bell consistently keeps the pressure high enough, there is no need to put CO2 gas back into beverage, because it never will come out.

A circuit is to be added for recovery mode and is shown in the electrical schematic section.

Displacement Matter and Electric Control Circuits

FIG. 20 shows a schematic diagram of the displacement matter passageway 1002 and the electrical circuits. Also shown are the various sensors, controls, compressor and components already introduced and described in earlier sections that control the displacement matter 1000. Wire 1430, electrical conductor wire has been put into the diagram to show the electrical connections that are needed to make the PREFERRED embodiment of the volumetric displacement device work.

The pressure in the container can be read from the pressure gauge 1115. It also has means to determine which mode the volumetric device is in. Areas are depicted on the gauge that indicate Delivery, Save and Rejuvenate Modes can be in color so the user has a clear idea what the mode is and what the condition of the pressure in the VD is. For example Save Range is Red, Green for Delivery Range, Blue no pressure mode and gray indicates over pressurization or over pressure. FIG. 20*a* shows a pressure gauge 1115 with appropriate areas marked to serve as mode indicators. Pressure gauge needle 1117 serves to read the pressure, and to point to the mode indicator. One area shown is the no pressure indicator 1120 printed on the dial face. The others are delivery mode indicator 1121, save mode indicator 1123, rejuvenate mode indicator 1126 and over pressure indicator 1130

Adaptations could include led lights or other markings to indicate mode.

Positions

FIG. 30*a-c* shows the volumetric displacement device 200 in various positions.

Neck Down Position

FIG. 30*a* shows the volumetric displacement device 200 in a neck down position. The volumetric displacement device is shown standing on it's bottom closure feet. The neck down position has the wonderful capability to never allow CO2 to escape the system, and to do so without a pickup tube. Since the CO2 bubble will always be away from the point of exit of usable material till the usable material is used up, there will never be a loss of CO2 which is always ready to rejuvenate any beverage that has lost any of it's CO2.

The delivery point of the usable material 944 that is away from the CO2 gas bubble, so CO2 won't exit container.

The volumetric displacement device in the neck down position has no need for a pickup tube 930, as is shown in FIG. 30*d*. In this position, since the CO2 gas bubble is near the usable material passageway 902 opening if it doesn't have a pickup tube, a pickup tube is installed so that CO2 gas is not expelled during delivery.

Neck Horizontal Position

FIG. 30*b* shows the volumetric displacement device 200 in a neck horizontal position.

Horizontal is a preferred position in refrigerator. The volumetric displacement device is shown resting on it's side closure feet. The neck horizontal position has the capability to never allow CO2 to escape the system, and to do so without a pickup tube. Since the CO2 bubble will always be away from the point of exit of usable material 944 till the usable material 944 is used up, there will never be a loss of CO2 which is always ready to rejuvenate any beverage that has lost any of it's CO2.

The volumetric displacement device in the horizontal position has feet which prevent the round container from rolling when that container is placed on it's side whereby the container won't roll around in a refrigerator on a counter top when put in a sideways position for convenient dispensation.

The closure has a flat spot on the side where it rests in the neck horizontal position that prevents the volumetric displacement device from rolling.

Neck Up Position

FIG. 30*c* shows the volumetric displacement device 200 in a neck up positions. The container rests on it's bell feet. This position is particularly useful for venting excess CO2 gas from the bottle.

3/2 Adaption

FIG. 40 shows a 3 to 2-liter adaptor 630, for three liter volumetric displacement device 200 to use two liter bottles. The adaptor is a short tube with 3 to 2-liter adaptor male threads 633 on the outside and 3 to 2-liter adaptor female threads 636 on the inside. In this manner the 3 to 2-liter adaptor 630 can be engaged with the closure to bottle neck threads 460, and the conventional bottle neck threads 810 of a two liter bottle. In this way a single volumetric displacement device can use either 2 liter or 3 liter conventional soda bottles. 3 to 2-liter screw driver slot 638 is formed in the 3 to 2-liter adaptor 630 so it can be tightened to the seal, or removed.

A 2 liter has approximately a ⅞ inch diameter while 3 liter has approximately 1³⁄₁₆ internal diameter. The external diameters are 1⅛ inch and 1½ inch respectively.

A 3 to 2-liter screw driver slot 638 allows removal of the adaptor with a coin.

Operation of the Preferred Embodiment

A bottle of soda, if partially consumed, will not store soda well. Even if the bottle is capped, the CO2 gas in the soda will leave the soda and go into the head space. If however, the sealed bottle is put under sufficient pressure externally, since the container is flexible, the pressure will be transmitted to the carbonated beverage stored within the bottle. This is the concept behind the volumetric displacement device described as the PREFERRED embodiment. Pressure is applied to the bottle from compressed air, that is created by a compressor, and pushed into a container that also holds the flexible bottle of soda. In this manner, the soda will be preserved.

A means for bi-directional transport of usable material between the environment and the usable material chamber 901 is provided. Usable material 944 is put into the bottle by the bottling company. usable material 944 exists the volumetric displacement device through the usable material passageway 902 and usable material nozzle. A means for bidirectional transport of displacement matter 1000 between the environment and the displacement matter chamber 1001 is provided via the displacement matter passageway 1002. With these transfers, the volumetric displacement device can be caused to maintain a full fill state which protects the soda. In this case, compressed air is considered to be displacement matter 1000.

A conventional flexible bottle of soda is opened and partially consumed. Some of the Soda is consumed before the device is put into the volumetric displacement device because if the bottle if full of soda, it will more easily over pressurize the displacement matter 1000. The bottle needs to be brought to a low pressure to deliver soda that is not foamy and flat, and if the bottle is full of soda, it is difficult to lower the pressure.

The user removes the bell from the closure. With the bottle in an upright position, the user squeezes the bottle with their hand until all the air is removed from the bottle, and the level of soda comes up the neck of the bottle till it is at the top lip. The user then screws the closure onto the bottle neck, engaging the bottle neck threads and the closure to bottle neck threads. The user rotates the closure relative to the bottle so that the closure is screwed onto the bottle securely, and tightly sealed there.

The user puts the closure on its feet so that the volumetric displacement device will be in the neck down position. The bell is then screwed tightly onto the closure engaging the bell to closure threads and the closure to bell threads. Silicon grease may be put on the seal between the bell and the closure to ensure a good seal.

The power switch is turned on. The Save Mode toggle is set to save mode. With charged batteries in the volumetric displacement device the pressure will come up to save mode pressure. The compressor automatically turns off when save mode pressure is reached. The volumetric displacement device may now be stored in the refrigerator. The flexible bottle will collapse under the pressure of the air. Soda will completely fill the bottle as conditions of temperature and pressure are appropriate.

The volumetric displacement device will be in a full fill state with displacement matter 1000, compressed air, and beverage completely filling the container. In this condition, CO2 gas can not leave the beverage, and the beverage is preserved.

When the user a serving of soda from the volumetric displacement device, she may either use the volumetric displacement device right in the refrigerator or take it out to use on the counter. The volumetric displacement device is put into either the neck horizontal or the neck down position. The user turns of the Save Mode toggle and the power to the compressor battery. The user then presses the pressure release button to bring the pressure down to near Zero. Holding the usable material nozzle over a suitable drinking cup to put the soda in such as a drinking glass, the user opens the usable material nozzle and engages the delivery mode switch. The volumetric displacement device will gently pump out good soda for the user to drink.

When the user has enough, he closes the usable material nozzle and shuts of the delivery mode switch. He turns on the power to the compressor and engages the save mode switch once again, so that he volumetric displacement device may be returned to the refrigerator. The cycle may be repeated for more servings.

If the user notices a bubble of free CO2 above the beverage, she may turn on the power and engage the rejuvenate mode switch. When the pressure in the container reaches Rejuvenation pressure the compressor automatically shuts off. The user may then shake the volumetric displacement device, or let a little pressure out to reengage the compressor which will vibrate the CO2 back into the beverage. The user may store the beverage at rejuvenate mode pressure and let the CO2 gradually return to the beverage.

Beverage will rejuvenate at save mode pressure, but will rejuvenate faster at rejuvenate pressure.

If it is warm or if the bottle is too full of beverage, the user may need to remove some of the CO2 gas so that the volumetric displacement device pressure can be dropped to delivery mode pressure. This over carbonation condition occurs when it is either too warm for the soda to hold all the gas, or there is too much soda in the bottle. To correct this problem, the user turns the volumetric displacement device to the neck up position, resting it on the bell feet. The excess CO2 gas can be vented out the usable material nozzle, along with any soda that was in the usable material external hose. After venting, the volumetric displacement device is used normally.

It would be expected that the batteries of the volumetric displacement device would eventually run out of charge. They are removed from the volumetric displacement device and put into a conventional battery charger. Charged batteries are returned to the volumetric displacement device to make it operate again.

Because of the construction of the volumetric displacement device, CO2 gas need never be lost. Any gas that exits the beverage, remains in the container as long as delivery is done in the neck down or neck horizontal positions. Any CO2 gas that exists the beverage can be driven back into the flat soda using the pressure the volumetric displacement device can apply to the bottle with the displacement matter, compressed air.

Displacement matter 1000 is pumped into a displacement matter chamber 1001, via a displacement matter passageway 1002, the displacement matter chamber 1001 separated from a usable material chamber 901 by a displacement partition. Under such displacement, usable material 944 is forced from the container out the usable material passageway 902.

As the pressure is applied, and the beverage removed, the bottle will be crushed. It will collapse to the point where most of the beverage is removed. To get the last bit of beverage out, the user drops the pressure in the volumetric displacement device, opens the bell, removes the bottle in the neck up position, and can then pour the remaining beverage out of the open bottle.

Sipper

The volumetric displacement device described can be used as a soda sipper. Instead of pouring the soda into a drinking cup, the user may shoot the beverage directly into their mouth, making the volumetric displacement device serve as a sipper. Smaller units could be made to handle 16 ounce, 20 ounce, one liter or most any convenient sized flexible bottle.

Conventional Compression Chamber Method

In this method, the usable material passageway 902 of the volumetric displacement device is not employed. The volumetric displacement device serves as a compression chamber or a conventional compression chamber can be used. The described three liter volumetric displacement device is used to preserve a 2 liter or smaller conventional PET bottle which will fit into the container of the volumetric displacement device with the conventional cap on the soda bottle. The threads of the bottle neck do not engage the closure in this method. The bottle of soda is opened and partially consumed. After finishing consumption, user squeezes bottle till no more air is inside the bottle, and fluid level comes up to top of the bottle. The bottle is capped and sealed with its conventional cap. The bottle is put into refrigerator for storage, or put into the volumetric displacement device, the volumetric displacement device sealed, and put into refrigerator. When user wishes to consume more soda, he pressurizes the volumetric displacement device to save or rejuvenate mode until the CO2 gas goes back into the beverage. The bottle of carbonated soda is removed from the volumetric displacement device or conventional pressure chamber. The cap is removed from the bottle. The soda can be poured out and consumed in the regular way. The save cycle can be repeated.

Cleaning

The volumetric displacement device described may be cleaned in special ways. Beverages spilled in the volumetric displacement device need to be cleaned out.

The usable material passageway 902 is cleaned by putting a cleaning agent such as soapy water into a bottle. The bottle is then installed in the volumetric displacement device in the conventional way. Pumping the water out in any mode, including save and rejuvenate mode, cleans out the usable material passageway 902.

The displacement matter passageway 1002 may also be cleaned by causing cleaning agent to enter the air inlet. This water will be pumped about the displacement matter passageway 1002 and its associated components including the compressor cylinder and piston seal.

The valves may be removed by taking out the valve screws. Valves and seats may then be cleaned with cleaning agents, and the valves reinstalled.

Cooling

Air is forced through the compressor vent groves 455, by the cooling fan 1257.

Breakage

The volumetric displacement device container consists of two pieces, the bell 300 and the closure 400 where the closure is relatively heavy and the bell 300 is relatively light.

When they separate under pressure, the gravitational inertia of the heavy piece would cause it to remain relatively motionless, while the light piece would be relatively large in relation to it's size, thereby not being a danger because it could not strike a person with considerable force, nor could it travel in the air very far because of air resistance to it's motion.

Alternate Embodiment

Internal Displacement Matter Chamber Variation

FIG. 70 shows an internal displacement partition embodiment of the volumetric displacement device 200*i*, internal displacement partition model. This embodiment functions in similar manner to the PREFERRED embodiment, however, the Displacement partition 820 is a flexible bag. It can be constructed of an aluminized polyester nylon laminate sheet such as made by Ludlow. This sheeting is extremely gas impermeable, so as to hold the CO2 gas. The edges of patterns cut out can be sealed with a warm iron. The Displacement partition 820 is formed in the described manner with a small neck at the base which is left open. The displacement matter passageway 1002 of the preferred embodiment is changed so that there is only one entrance into the displacement matter chamber 1001. That entrance is at the base of the closure and runs into the neck of the bottle. Into that opening a Displacement partition bottle pipe barb 825 of metal is inserted and sealed. The Displacement partition 820 is secured to the Displacement partition bottle pipe 825 by placing the opening of the displacement partition over the Displacement partition bottle pipe 825 end. The joint is secured with plumbers goop and a Displacement partition clamp 830, a conventional hose clamp.

In use, the Displacement partition 820 is furled and inserted into a conventional bottle of soda 800. The bottle is then screwed into the volumetric displacement device 200*i*.

The device is ready to use in the same manner as the PREFERRED embodiment volumetric displacement device 200

Displacement Partition Valve

FIG. 140 shows a displacement partition valve 1700. One problem with displacement partitions is that if there is pressurize material within the flexible partition, if there is a leak or opening in the displacement matter passageway 1002 the pressurized displacement matter chamber 1001 can blow the displacement partition 820 out the displacement matter passageway 1002 rupturing the displacement partition 820. Also, the pressure of a carbonated beverage will force displacement matter 1000*a* water out the usable material passageway 902 making a mess.

FIG. 140 shows a displacement partition valve that solves this and other problems. Container 205, containment means with conventional bottle neck 805 and conventional bottle neck threads 810 has a displacement partition 820 of flexible material affixed in its usable material passageway 902. In the usable material chamber 901, is usable material 944, carbonated beverage, soda, beer. Displacement matter 1000*a* water, is in the displacement matter chamber 1001. A displacement partition valve 1700 is constructed by making a tough spot, thick spot 1710 on the displacement partition 820. The tough spot, thick spot 1710 is positioned in such a manner that if the displacement partition 820 where to have excess pressure in it, it would blow it self up so that he tough spot, thick spot 1710 would cover the opening in the displacement matter passageway 1002, and seals the displacement matter passageway 1002. Further more, the end of the displacement matter passageway 1002 has displacement matter screen, grid 1735 over the opening to further assist the displacement partition from exiting the container. Another grid/screen, a usable material chamber screen, grid 1740 is place over the opening to the usable material passageway 902. This would prevent pieces of the displacement partition from exiting the container in the event of displacement partition 820 failure.

For example, the cap is inadvertently removed from the displacement matter passageway 1002. Water tries to rush out of the bottle as the displacement partition 820 expands. The pressure however, cause the displacement partition valve 1700 to close and catastrophe is averted. Tough spot 1710 can be formed by a thickening of the materials forming the displacement matter partition 820. It can be reinforced fibers, another material affixed to the displacement partition 820. If the material of the displacement partition is strong enough, the grid will hold it from breaking.

Volumetric Displacement Device Variation

It is beneficial to view the inner workings of the volumetric displacement device. Viewing ports can be provided into the displacement matter chamber 1001, the bell, and into the closure itself, especially in the frame embodiment of the closure. Viewing ports can be made on both the Bell and on the Closure. The volumetric displacement device becomes more attractive when it's inner workings can be viewed. Looking into the bell gives the user an idea as to how much beverage is left, allows for checking correct operation, and for trouble shooting as well as the esthetic advantages. The user doesn't have to wonder what's going on inside the container. It makes for easier operation. The user can check to see if a gas bubble has developed.

The volumetric displacement device that is colored whereby, the device can color code for what it containers, the volumetric displacement device is more attractive. The volumetric displacement device and especially the Bell that is clear and tinted with colored dyes or pigments, such that it will appear to have a color, yet the contents of the container inside are readily viewable.

Plurality of Bottles

FIG. 135 shows a volumetric displacement device with two bottles 800 and two bells 300. The pictured embodiment functions exactly the same way the preferred embodiment functions, except that there are two delivery nozzles 920, one for each bottle 800. The closure 400*d* has exactly the same parts, except there are two of each part for the usable material passageways 902. A portion of the displacement mater passageway 1002 communicates between the two displacement matter chambers 1001. Save mode and Delivery Mode will be the same in both containers at the same time. Loading the bottles 800, is done by rotating the bottle rather than the closure 400*d*.

A volumetric displacement device with two bottle is very convenient when two flavors of soda are desired, such as at a home bar that uses tonic and club soda. Small amounts of each can be delivered, while saving the rest for another time. Volumetric Devices with space for more bottles could be developed.

Container Variation

The walls of the container or insulation of any previously described device can be double walled to provide insulating layer internally, such as air evacuated space. That is the internal evacuated space can be like a thermos or thermopane window, evacuated argon, nitrogen or other gas.

Container can be composed of multilayer plastic.

Container of can be of PET plastic. Clear can go beyond bell, to entire container. Clarity gives user a "fuel gauge" to amount left. Allows for checking correct operation. Trouble shooting, Esthetics. The user doesn't have to wonder what's going on inside the container. Easier operation. Can check if gas bubble has developed.

Bell Variation

FIG. 85*a* shows a hemispherical bell 320. This bell formed in exactly the same manner as the preferred bell 300 has one difference. Instead of receiving bell feet 310, it has a hemispherical top. This would prevent the user from standing this bell in the neck up position.

FIG. 85*b* show a heavy bell 300*b*, that is made from heavier plastic such as might be found on a conventional water filter housing used in household plumbing applications. The bell 300*b* has a bell viewing port 350, a piece of clear plastic affixed to the inside of bell 300*b* at a hole formed in the bell 300*b*.

A bell could be made in many thicknesses. Possibilities include less than 10, or 20 or 30 or 40 or 50 or 60 or 70 or 80 or 90 or 100 Mils thickness or greater than 100 Mil thickness. Ovaloid shape of bell helps the strength at any thickness.

Material of Bell can be plastic, metal, ceramic, glass applicable. Resin fibers, resins, can be employed. Lexan, poly carbonate, kevlar, carbon fibers, PET, HDPE, LDPE can be used.

A multilayer bell of different materials can be employed which has safety features, heat insulating properties, blankets to protect under bursting and other features.

The thickness can be the same as conventional PET bottle, or somewhat thicker or thinner as different options. It is a pet bottle, with a limited internal pressure, a screw on closure, with vent groves in the threads. It is light weight and of the same material, similar construction, and similar thicknesses. In all, if the original bottle is safe, the new container based on construction similar should also be safe.

The thickness of the bell can vary for various reasons. For example, thin right next to the threads, so it breaks under excess pressure at the base near the mouth. A bell thick near threads or thinner as you go up stays more rigid during twisting on. It can also be thicker at top near hemisphere of top, so it can be turned from top.

Bell can be a thermos liner.

An opaque bell, can have a clear window set into it, instead of a completely clear bell. This allows opaque plastics to be used while the user is still able to view the bottle inside the container. This is important, as the user gets a great deal of information from being able to view the inside of the container as well as esthetic delight. The user can tell if rejuvenate mode is needed, if they see a gas bubble on the soda. They can tell how much soda is left. They can tell if the volumetric displacement device is leaking. They can tell if the volumetric displacement device is jammed for some reason.

A bell can be made that is transparent but color tinted. A container that is clear and tinted with colored dyes or pigments, will appear to have a color, yet the contents of the bottle inside are readily viewable.

The bell material can be colored, whereby the contents of the bottle is coded for. A container for a volumetric displacement device that is colored lets the device color code for what it containers and the volumetric displacement device is more attractive.

An ovaloid cylindrical container having hemispherical ends, radius of hemisphere substantially equal to radius of main cylinder is constructed in similar fashion to the PREFERRED embodiment. Bell top can be formed that is domed at the top.

Closure Variation, Frame

FIG. 80 shows a cross sectional view of a frame closure using hoses instead of passageways, and thin ovaloid closure lining.

FIG. 80*a* shows a perspective view of an ovaloid frame closure lining.

The frame variation of the closure is constructed to minimize the use of plastic in the closure, and to provide an ultra save embodiment. Of particular not is the closure 400*c*, frame closure is hollow to accept the parts mounted on it's framework. An ovaloid closure lining 440 constructed of plastic is mounted to the closure 400*c*. FIG. 80 a shows this closure lining 440 in more detail. The remaining parts of the closure are similar to the PREFERRED embodiment. A major difference is that the passageways bored into closure 400 of the PREFERRED embodiment are replaced with displacement matter hose 1005 and is secured with hose clamp 906 at each end point of the hose. The hose runs the same places that the previous bored passageways ran, but now secured with hose barbs, hose clamps, and convention barbed T's where junctions are needed. Instead of having a compressor cylinder bored out of the plastic, a conventional compressor assembly 1200*a* is mounted in the closure 400*c*. Suitable 12V compressors are commonly available for use in automotive tire application. They have a hose connected to them that will serve as a displacement matter hose 1005. The compressor contains internally a displacement matter intake valve 1025 and a displacement matter compressor exhaust valve 1030 so these parts are eliminated from the responsibility of the maker of this closure 400*c*. closure lining bottle neck thread housing 441 serves to hold the bottle 800 by it's threads. A displacement matter passageway quick fit valve 1045 conventional tire valve is attached to a hole in the closure lining 440. A displacement matter hose 1005 connects here to communicate the displacement matter chamber 1001 with the various parts that manage the compressed air, displacement matter 1000. The voids in the closure 400*c* are filled with closure insulation 410 which can be foam or other types of insulation to provide sound and vibration deadening. A clear closure viewing port 450 is provided so that the user can see into the workings of the volumetric displacement device. A closure cover 405, frame closure cover is used to seal the bottom of the closure.

One advantage of the frame closure 400*c* is that the thin closure lining 440 will not shatter if ruptured. It is light weight and will merely split if too much pressure is applied to it. Another advantage is that this closure will have enhanced sound and vibration characteristics as a result of the insulation it container. It will be quieter when running. A sound proof internal chamber for the compressor can be created.

The ovaloid surface of the closure is can be of a metallic reflective or otherwise decorative surface on the top of the closure, surface next to bottle to reflect it for better diagnostic viewing and Esthetics The neck of the bottle, near neck is attractive to view through plastic. The viewing window can show the bottle neck area. The more of the bottle you see, the prettier it is. A clear closure device allows more viewing of the container. Top of bottle, near neck is attractive to view through plastic. A Clear Closure allows user to view workings of systems. The closure incorporating at least one point of clear material such as PET, gives the user a view of the interior of the closure whereby the user has the ability to view the operation for trouble shooting, error conditions, fouling and Esthetics.

The closure lining 440 at bottle side of closure that is bottle shaped provides minimum air to compress. Ovaloid shape to bottle side of closure shape allows thin plastic.

The ovaloid closure or ovaloid closure surface can be thin, light weight, disposable, inexpensive, relatively strong in relation to it's weight especially as it assumes the functionality of containing pressure.

A high point for displacement matter passageway 1002 protection elevation tube out of the drink, and provides minimum air to compress. A conventional pressure safety release valves may be installed in the closure, in the bell container cover. A point of intake high on the closure ELB space, to prevent the intake of sugar water on an error condition. The conventional tire valve is mounted at a point where a small leakage of soda into the container won't go into the displacement matter passageway 1002 and foul it. This solves the problem of sugar syrup jamming the pressure safety valves. If said valves clog up for one reason or another, the light weight ovaloid closure would rupture in a controlled fashion. This closure could have premolded rip seams in it designed to rip at a given pressure. The light weight closure ovaloid could be readily replaceable as well.

The best weak link in the container, save the release valves, might be the interior surface of the closure body, which can be constructed in ovaloid, hemispherical, egg, shape of relatively thin material, that interior surface adjacent to the container. This surface shall be weaker than the bell. Rupture of this surface will cause the air to blow into and through vents of the compressor body, and not into the environment where humans might be present. The same philosophy will be applied to the hand pump model, so that breaks break into an enclosed area. There can be rip panels located in the closure, that break in controlled fashion as was discussed with the bell.

The closure lining can be light or heavy weight. In essence, the closure can become the weakest part of the container. This can be beneficial, because it means that any bursting of the container due to excessive pressure, can be forced to occur, at the closure piece. By making the bell thicker, and stronger, the closure member made of light weight material in an ovaloid shape, become the weak link. A closure liner becomes this weakest spot, so that if it breaks, any pieces that could fly would be trapped by the closure cover. The closure cover can be attached to the closure itself in a variety of means including screws, glue, fasteners, and other means.

Junction and Junction Variations

FIG. 90*a* shows a cross sectional view of the junction between bell and closure 400. Parts in this figure have already been introduced. It can be seen that a tight junction is made between the bell lip 710 which is the end point of the bell plastic and the bell to closure seal 750, which seals tightly to the closure 400. Also shown is the bell mouth 705

FIG. 90*b* shows a snap fit junction, 790. A snap fit bell 300*a*, is formed of PET plastic with a bell snap lip 725. Closure 400*a*, snap fit closure is formed of PET plastic with a closure snap lip 745. A bell to closure snap seal 750*a* is formed of a rubber like material and used to seal the junction between the bell 300*a* and the closure 400*a*. To operate the snap fit junction 790, the operator simply presses the bell into the closure until it snaps into place. Internal pressure expanding the container will help seal the junction and keep it tight. To open the junction, the operator presses the bell side and bell snap lip 725 inward until the bell 300*a* can be released from the closure 400*a*.

FIG. 90*c* shows variations of the volumetric displacement device presented in FIG. 120 in which the displacement matter passageway 1002 and the usable material passageway 902 are detachable and the junction can be located in different places. It can be seen that the Junction translates position along the container longitudinal axis 260.

Detachable Passageways.

FIG. 120 shows a volumetric displacement device 200*a* with a detachable usable material passageway and a detachable displacement matter passageway 1002. The bell 300 used in this embodiment is the same bell as used in the PREFERRED embodiment, volumetric displacement device 200. It has bell feet 310, and bell to closure threads 701. A closure 400*a*, quick connect closure, is formed of flexible PET plastic. Formed into the closure 400*a* are closure to bottle neck threads 460, closure to bell threads 730, and closure to usable material 944 quick fit valve threads 463. The bell 300 is secured to the closure utilizing a bell to closure seal 750. A bottle 800, conventional PET soda bottle is screwed to closure 400*a* utilizing a closure to bottle neck seal 610, by conventional bottle neck threads 810. Screwed onto the closure to usable material 944 quick fit valve threads 463, and glued is the usable material passageway quick fit valve 925, which is a conventional cornelious keg valve and seal.

A conventional usable material passageway quick fit connect 927, designed to fit a cornelious keg style connector, attaches to a usable material external hose 910 which connects to a usable material 944 valve 920, conventional carbonated beverage delivery valve nozzle. A displacement matter passageway 1002 quick fit valve 1045, conventional tire valve with washer and nut is attached into an appropriately placed hole in the closure 400*b*.

An ovaloid container has been constructed in that the bell 300 and closure 400*b* were formed in a shape so that together they form an ovaloid shaped container. A conventional tire pump 1280, conventional hand air pump, of any sort, or one powered either with human, battery, electric or other energy can be quickly fit to the tire valve.

Alternatively, the tire valve could be replaced with other types of quick connector fittings such as cornelious fitting or those found on conventional compressor pressure hoses.

The usable material fitting also would be replaceable with other types of quick fitting pressure connectors.

In use, the user puts a bottle of soda into the volumetric displacement device 200*b* in much the same manner as she puts the bottle into the preferred embodiment. The user then has the option of blowing up the volumetric displacement device 200*b* at the tire valve to save mode pressure. While in save mode, the volumetric displacement device 200*b* is stored in the refrigerator. The user uses a conventional tire valve depressor 1085 to release pressure in the volumetric displacement device 200*b* to create a delivery mode. Alternatively, the a user pressure release valve could be installed into the closure.

The user attaches the usable material passageway 902 quick fit connect 927, and can take soda from the volumetric displacement device 200*b* by opening the usable material valve 920 and pumping small amounts of air into the tire valve.

Cap Piercing

FIG. 100 shows a cap piercing volumetric displacement device 200*p*. The construction is the same as the preferred embodiment, except as follows. A modified ovaloid piercing closure lining 440*b* is formed of PET plastic. A displacement matter passageway quick fit valve 1040 is attached to the ovaloid piercing closure lining 440*b*. A cap piercing member 950, a hollow tube of steel with a sharp point and with left handed cap piercing member cap threads 955 and cap piercing member closure threads 951 is firmly threaded into, sealed and secured to the ovaloid piercing closure lining 440*b*. A usable material external hose 910, attached with a usable material valve 920 is secured to the cap piercing member 950 with a hose clamp 916. To use volumetric displacement device 200*p* a conventional PET soda bottle 800 is tightly sealed with a conventional bottle cap 945. The user takes the bell off the ovaloid piercing closure lining 440*b* and screws the bottle 800 in a counter clockwise manner onto the cap piercing member cap threads 955. The reason for screwing on in a counter clockwise manner, is to more firmly tighten the cap on the bottle 800, and to keep it on. The bottle 800 will be firmly attached to the closure lining 440*b* as the bottle 800 seals against closure to bottle neck piercing seal 610*b*. The cap piercing volumetric displacement device 200*p* is Alternatively in operation, the user may remove the cap from the bottle, pour some of the soda out, squeeze the bottle to remove all air, and then replace the cap before putting the bottle into the volumetric displacement device 200*p*. This will help to prevent over pressurization of the volumetric displacement device 200*p*.

Refrigerator Power Access

FIGS. 110*a-g* shows how power could be delivered to a volumetric displacement device from the exterior of a conventional refrigerator to the interior of the refrigerator. If the volumetric displacement device is placed in a refrigerator, the user might not want to keep changing it's batteries or recharging the batteries outside the refrigerator. He can accomplish this objective by running the power into the refrigerator and connecting it to the volumetric displacement device.

FIG. 110*a* shows a thru refrigerator ribbon conductor 1600*a*. It has a ribbon connector 1617 attached to either end, one of which connects to a battery charger 1635 the other to a volumetric displacement device rack 1665. The volumetric displacement device rack 1665 holds the volumetric displacement device 200 and makes electrical contact to it through volumetric displacement device to battery charger contacts 1465 and battery recharge to volumetric displacement device contacts 1460 thereby providing power to the battery to keep it charged.

The ribbon conductor 1600*a* is bonded to the body of the refrigerator body 1600 at the edge where the door gasket 1655 makes contact as show in FIG. 110*b* and FIG. 110*c*. FIG. 110*d* shows how the thru refrigerator ribbon conductor 1600*a* is constructed. Note that the electrical insulator 1615 that houses the electrical conductor 1610 at its edges is tapered to allow the door gasket 1655 to seal to the refrigerator body 1650. It is also note that voltage in the refrigerator ribbon conductor 1600*a* is low, around 12 V in this embodiment, to keep it safe.

Figure 110E:
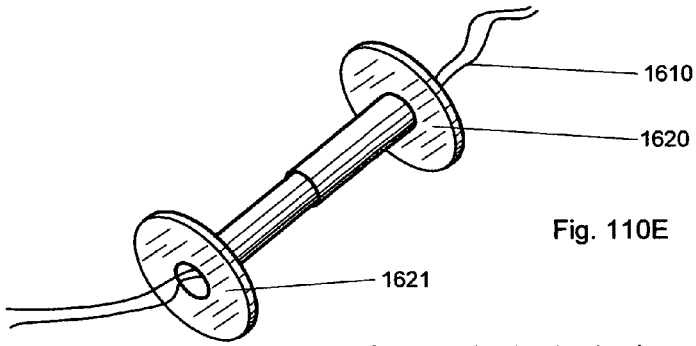
Figure 110F:
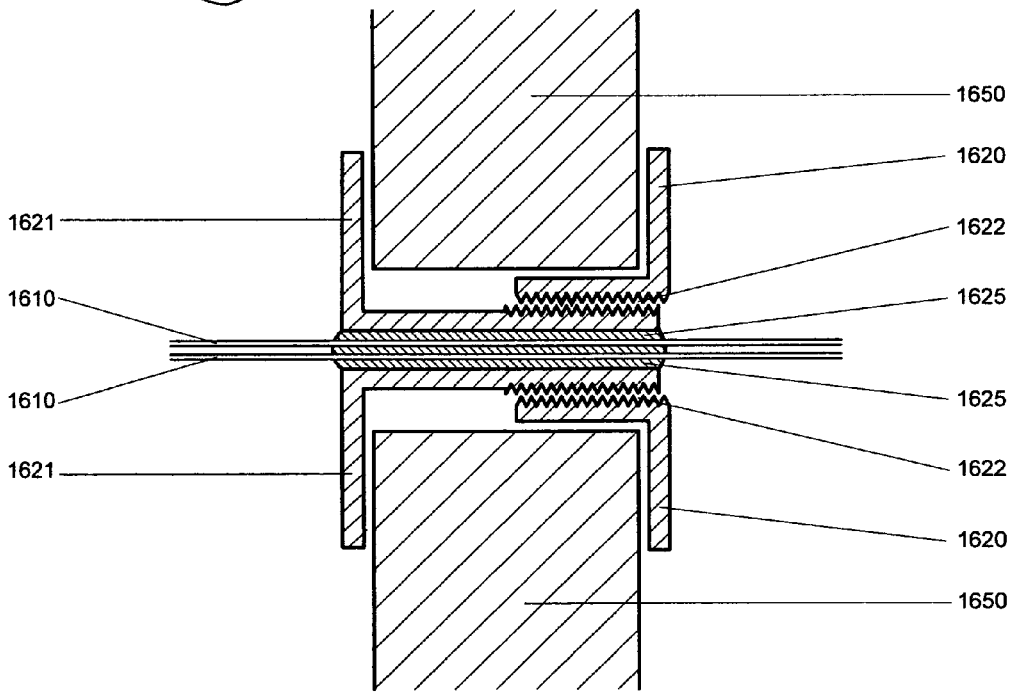

FIG. 110*e-f* shows another way to get electricity into a conventional refrigerator body 1650. A hole is bored somewhere in the body of the refrigerator to accept a refrigerator through tube exterior 1620 and a refrigerator through tube interior 1621 formed of plastic, which have refrigerator through tube threads 1622 to hold them together. Through the refrigerator through tube exterior 1620 and a refrigerator through tube interior 1621 pass electrical conductors 1610, which in this case are insulated wires. The interior of the refrigerator through tube interior 1621 is then packed with through tube insulation 1625 which is standard spay in insulation that hardens after spraying. Connections are made in similar fashion to those described for the thru refrigerator ribbon conductor 1600*a*.

Figure 110G:
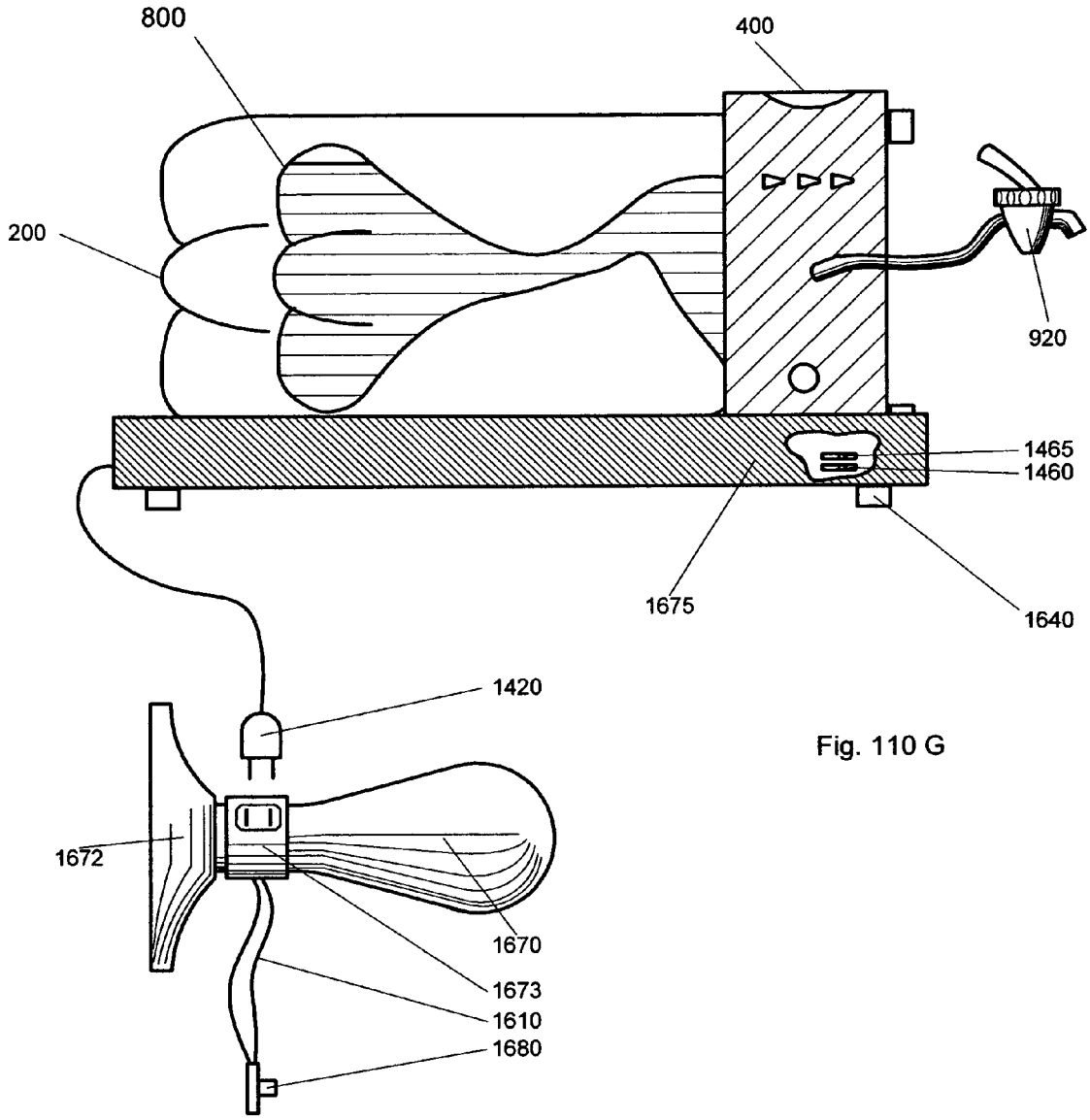

FIG. 110*g* shows another way power can be delivered to the volumetric displacement device. The light in the refrigerator light 1670, is removed, and a refrigerator light socket adaptor 1673 is screwed into the refrigerator light socket 1672. The conventional installed light switch at the door of the refrigerator is disabled by shorting it out, or cutting it off. This forces the light circuit to remain on for the battery charger which is plugged into the refrigerator light socket adaptor 1673. The refrigerator light socket adaptor 1673 is wired to a auxiliary door switch 1680, as second door switch that is mounted between the refrigerator body 1650 and the refrigerator door gasket 1655 when closed. This circuit now controls the refrigerator light while the refrigerator light 1670 screwed into the refrigerator light socket adaptor 1673 operates with the auxiliary door switch 1680. FIG. 110*g* also shows refrigerator clips 1640, which allows the rack battery charger 1675, a rack that will hold the volumetric displacement device 200 and a battery charger at the same time to mount securely to a rack in a conventional refrigerator.

If the battery is discharged or removed to make a version without batteries, the power supply will run the volumetric displacement device 200 with batteries or not for all embodiment discussed in FIG. 110*a-g*.

CONCLUSION, RAMIFICATIONS, AND SCOPE OF INVENTION

The reader can see that a volumetric displacement device has been constructed that is extremely light, small, safe, attractive, easy to use, and energy efficient. It can use battery power, has an Ovaloid shape that can be constructed of thin plastics, and operates in various positions that eliminate the need for a pickup tube. A consistent problem with soda savers, in that they destroy carbonated beverages by delivering them in a violent manner, has been solved by utilizing a low pressure delivery mode. The volumetric displacement device can be used for most any carbonated beverage. This volumetric displacement device will be inexpensive to produce. The volumetric displacement device delivers soda out a nozzle that is easy to use.

The described volumetric displacement device functions a carbonated beverage saver and dispenser. Carbonated soft drinks in bottles stay carbonated even after the contents of the bottle is partially consumed.

While the above description contains many specificity, these should not be construed as limitations on the scope of the invention, but rather as exemplification of a few embodiment thereof. Many other variations are possible.

I claim:

1. A volumetric displacement device comprising:

(a) an outer containment means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (e) said displacement partition is a flexible bottle, and further comprising (f) neck-down stabilization means for stabilizing said volumetric displacement device with said bottle in a substantially neck-down position whereby said volumetric displacement device is able to maintain a full fill state.

2. A volumetric displacement device comprising:

(a) an outer containment means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (e) said usable material is a carbonated beverage, and further comprising (f) an internal pressure regulation means for substantially lowering the internal pressure in said usable material chamber, and wherein (g) said internal pressure regulation means provides for the removal of a substantial portion of the displacement matter from said volumetric displacement device prior to the removal of said beverage whereby a non-violent, low pressure dispensation mode can be attained without prior removal of said beverage and said dispensed beverage is protected from foaming, frothing and loss of carbonation during dispensation and said volumetric displacement device is able to maintain a full fill state.

3. The volumetric displacement device of claim 2 wherein said internal pressure regulation means is a relief valve.

4. The volumetric displacement device of claim 2 wherein said displacement matter is compressed air.

5. The volumetric displacement device of claim 2 where said displacement partition is a flexible bottle.

6. A volumetric displacement device comprising:

(a) an outer containment means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (e) said usable material is a carbonated beverage, and further comprising (f) a save mode in which the internal pressure in members selected from the group usable material chamber and usable material passageway are relatively high, and (g) a delivery mode in which the internal pressure in members selected from the group usable material chamber and usable material passageway are relatively low, and (h) a mode switching means for changing said volumetric displacement device between save mode and delivery mode whereby said beverage may be stored at a relatively high pressure which is suitable for keeping CO2 gas in solution for long periods of time and dispensed at a relatively low pressure which is suitable for a non-violent delivery of beverage thus preventing it from foaming, frothing and loss of carbonation during dispensation and said volumetric displacement device is able to maintain a full fill state.

7. The volumetric displacement device of claim 6 wherein said mode switching means is a compressor that can be run with properties selected from the group consisting of multiple speeds, multiple air output volumes, multiple electric voltages, and multiple on/off pressure ranges.

8. The volumetric displacement device of claim 6 where said displacement partition is compressed air.

9. The volumetric displacement device of claim 6 where said displacement partition is a flexible bottle.

10. A volumetric displacement device comprising:

(a) an outer containment means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (e) said displacement partition is a flexible bottle, and (f) members selected from a pressure group consisting of (compressor, compressor piston, compressor parts, batteries, connecting wires, displacement matter intake valve, displacement matter compressor exhaust valve, pressure sensors, compressor switches, pressure release valve) are located substantially within an ELB space, whereby the members selected from said pressure group will be located approximately adjacent to the neck of said bottle and said volumetric displacement device is able to maintain a full fill state.

11. A volumetric displacement device comprising:

(a) an outer containment means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (a) said displacement partition is a flexible bottle, and (b) members selected from a pressure group consisting of (compressor, compressor piston, compressor parts, batteries, connecting wires, displacement matter intake valve, displacement matter compressor exhaust valve, pressure sensors, compressor switches, pressure release valve) have properties selected from the group consisting of (are contiguous with, are attached directly to, are integral with, are housed by, are located within, and are composed in part by) the closure of said displacement partition whereby said volumetric displacement device is able to maintain a full fill state.

12. A volumetric displacement device comprising:

(a) an outer containment means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (e) said displacement partition is a flexible bottle, and (f) members selected from a pressure group consisting of (compressor, compressor piston, compressor parts, batteries, connecting wires, displacement matter intake valve, displacement matter compressor exhaust valve, pressure sensors, compressor switches, pressure release valve) have properties selected from the group consisting of (are contiguous with, are attached directly to, are integral with, are housed by, are located within, and are composed in part by) the closure of said outer containment means whereby said volumetric displacement device is able to maintain a full fill state.

13. A volumetric displacement device comprising:

(a) a outer displacement means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (e) said displacement partition is a common, conventional standard PET carbonated beverage bottle as produced in 2004 , and further comprising (f) a bottle closure with members selected from a pressure group consisting of (compressor, compressor piston, compressor parts, batteries, connecting wires, displacement matter intake valve, displacement matter compressor exhaust valve, pressure sensors, compressor switches, pressure release valve) attached relatively directly to said closure wherein when said bottle is set to rest directly and substantially upright in the center of a square flat surface such as a table top so as to be in a substantially neck-up position, with said square flat surface measuring at least 3 feet on each side, said bottle closure with attached pressure group members can be relatively easily caused to rotate about the longitudinal axis of said bottle with just one hand of a human operator as said closure of said bottle is screwed onto said bottle with only one hand, while at the same time the other hand of said human operator grips said bottle without letting go as said closure is screwed from completely disengaged with the conventional PET bottle neck threads, to fully engaged with said bottle neck threads so that said closure is relatively tightly secured and screwed onto said bottle whereby said volumetric displacement device is able to maintain a full fill state.

14. A volumetric displacement device comprising:

(a) an outer containment means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (e) said usable material is a carbonated beverage, and further comprising (f) an air compression means for supplying compressed air to said displacement matter chamber, and (g) a displacement matter passageway connection means which alternately disconnects and reconnects said air compression means from said displacement matter chamber, and (h) a displacement matter passageway valve means located between said displacement matter passageway connection means and said displacement matter chamber, inclusive of said location of said displacement matter passageway connection means, for preventing undesirable bi-directional transport of said displacement matter between said displacement matter chamber and the environment whereby said volumetric displacement device may be disconnected from said compressor and it's power supply without said volumetric displacement device loosing compressed air to the environment, and may be placed into a conventional refrigerator and said volumetric displacement device is able to maintain a full fill state.

15. A volumetric displacement device comprising:

(a) an outer containment means, and (b) a displacement partition located substantially within said outer containment means so as to form two distinct chambers, a displacement matter chamber and a usable material chamber, and (c) a means for bi-directional transport of usable material between the environment and said usable material chamber, and (d) a means for bi-directional transport of displacement matter between the environment and said displacement matter chamber, and wherein (e) said usable material is a carbonated beverage, and (f) said displacement partition is a flexible bottle, and further comprising (g) a faucet means for controllable bi-directional exchange of usable material between said usable material chamber and the environment, and (h) a usable material passageway connection means which alternately disconnects and reconnects said faucet means from said usable material chamber, and (i) a usable material passageway valve means located between said usable material passageway connection means and said usable material chamber, inclusive of said location of said usable material passageway connection means, for preventing undesirable bi-directional transport of said usable material between said usable material chamber and the environment whereby said volumetric displacement device may be disconnected from said faucet without said volumetric displacement device inappropriately disgorging usable material, and may be placed into a conventional, refrigerator and said volumetric displacement device is able to maintain a full fill state.

16. A method for removing usable material from a volumetric displacement device comprising the steps of:

(a) providing the volumetric displacement device of claim 2 for maintaining a substantially full-fill state, and (b) in an initial stage, occupying a usable material chamber of said volumetric displacement device with a positive initial volume of a usable material, and introducing a non-negative initial volume of a displacement matter into a displacement matter chamber of said volumetric displacement device separated from said displacement matter chamber using a displacement partition means comprising a flexible membrane, thereby substantially filling said volumetric displacement device and substantially causing said volumetric displacement device to attain a full fill state, and (c) waiting some period of time of undetermined duration, and (d) removing ax least some volume of said displacement matter from said displacement matter chamber thereby reducing the pressure in said volumetric displacement device, and (e) removing at least some volume of said usable material from said usable material chamber, leaving a remaining volume of said usable material, and (f) introducing into said displacement matter chamber, a volume of new displacement matter thereby substantially filling said volumetric displacement device and substantially causing said volumetric displacement device to attain a full fill state, and (g) repeatedly so-removing displacement matter from said displacement matter chamber, and repeatedly so-removing usable material from said usable material chamber, and repeatedly so-introducing new displacement matter into said displacement matter chamber, thereby substantially continuously maintaining said device in a substantially-full state, as often as desired, until substantially all of said usable material has been removed from said volumetric displacement device, whereby a usable material may be removed from said volumetric displacement device in a low pressure, non-violent manner.

17. A method for forcing a usable material from a volumetric displacement device comprising the steps of:

(a) providing a volumetric displacement device for maintaining a substantially full-fill state having a pressure release valve means for allowing the removal of a displacement matter from a displacement matter chamber and a useable material valve means for allowing the removal of said usable material from a usable material chamber, and (b) in an initial stage, occupying said usable material chamber of said volumetric displacement device with a positive initial volume of said usable material, and introducing a non-negative initial volume of said displacement matter into said displacement matter chamber of said volumetric displacement device separated from said displacement matter chamber using a displacement partition means comprising a flexible membrane, thereby substantially filling said volumetric displacement device and substantially causing said volumetric displacement device to attain a full fill state, and (c) waiting some period of time of undetermined duration, and (d) removing at least some volume of said displacement matter from said displacement matter chamber by opening said pressure release valve means thereby reducing the pressure in said volumetric displacement device, and (e) closing said pressure release valve means and opening said usable material valve means so that said pressure release valve means is closed while at the same time said usable material valve means is open, and (f) forcing at least some volume of said usable material from said usable material chamber by forcing a quantity of said displacement matter into said displacement matter chamber, leaving a remaining volume of said usable material, and (g) introducing into said displacement matter chamber, a volume of new displacement matter thereby substantially filling said volumetric displacement device and substantially causing said volumetric displacement device to attain a full fill state, and (h) repeatedly so-removing said displacement matter from said displacement matter chamber, and repeatedly so closing said pressure release valve means while opening said usable material valve means, and repeatedly so-forcing usable material from said usable material chamber, and repeatedly so-introducing new displacement matter into said displacement matter chamber, thereby substantially continuously maintaining said device in a substantially-full state, as often as desired, until substantially all of said usable material has been removed from said volumetric displacement device, whereby a usable material may be removed from said volumetric displacement device in a low pressure, non-violent manner.

18. The method of claim 17 for removing said usable material from said volumetric displacement device where said displacement matter is compressed air.

19. A method for removing usable material from a volumetric displacement device having an outer containment means by using energy to force a displacement matter into a displacement chamber of said volumetric displacement device comprising the steps of:

(a) providing said volumetric displacement device having a displacement matter forcing means external to the inner surface of said outer containment means, said forcing means used to force said displacement matter into said displacement matter chamber, said volumetric displacement device capable of maintaining of substantially full-fill state, and (b) in an initial stage, occupying a usable material chamber of said volumetric displacement device with a positive initial volume of a usable material, and introducing a non-negative initial volume of a displacement matter into a displacement matter chamber of said volumetric displacement device separated from said displacement matter chamber using a displacement partition means comprising a flexible membrane, thereby substantially filling said volumetric displacement device and substantially causing said volumetric displacement device to attain a full fill state, and (c) waiting some period of time of undetermined duration, and (d) removing at least some volume of said displacement matter from said displacement matter chamber thereby reducing the pressure in said volumetric displacement device, and (e) removing at least some volume of said usable material from said usable material chamber, leaving a remaining volume of said usable material, and (f) forcing into said displacement matter chamber with said displacement matter forcing means, a volume displacement device and substantially causing said volumetric displacement device to attain a full state, and (g) repeatedly so-removing displacement matter from said displacement matter chamber, and repeatedly so-removing usable material from said usable material chamber, and repeatedly so-introducing new displacement matter into said displacement matter chamber, thereby substantially continuously maintaining said device in a substantially-full state, as often as desired, until substantially all of said usable material has been removed from said volumetric displacement device, whereby said displacement matter forcing means such as an air compressor may be attached to said volumetric displacement device and used to force, with energy, said displacement matter into said displacement matter chamber and said usable material may be removed from said volumetric displacement device in a low pressure, non-violent manner.

20. The method of claim 19 for removing said usable material from said volumetric displacement device where said displacement matter is compressed air.

21. A method for removing usable material from a volumetric displacement device utilizing a conventional flexible bottle with conventional bottle neck and conventional bottle neck threads as a displacement partition comprising the steps of:

(a) providing said volumetric displacement device for maintaining a substantially full-fill state, and (b) providing said conventional flexible bottle with conventional bottle neck and conventional bottle neck threads to serve as a displacement partition, and (c) screwing said conventional flexible bottle with conventional bottle neck and conventional bottle neck threads to threads of said volumetric displacement device, and (d) closing an outer containment means about said conventional flexible bottle dividing the interior of said outer containment means into a usable material chamber and a displacement matter chamber and so that said conventional flexible bottle is inside of and within said outer containment means, (e) in an initial stage, occupying said usable material chamber of said volumetric displacement device with a positive initial volume of a usable material, and introducing a non-negative initial volume of displacement matter into said displacement matter chamber of said volumetric displacement device, thereby substantially filling said volumetric displacement device and substantially causing said volumetric displacement device to attain a full fill state, and (f) waiting some period of time of undermined duration, and (g) removing at least some volume of said displacement matter from said displacement matter chamber thereby reducing the pressure in said volumetric displacement device, and (h) removing at least some volume of said usable material from said usable material chamber, leaving a remaining volume of said usable material, and (i) introducing into said displacement matter chamber, a volume of new displacement matter thereby substantially filling said volumetric displacement device and substantially causing said volumetric displacement device to attain a full fill state, and (j) repeatedly so-removing said displacement matter from said displacement matter chamber, and repeatedly so-removing usable material from said usable material chamber, and repeatedly so-introducing new displacement matter into said displacement matter chamber, thereby substantially continuously maintaining said device in a substantially-full state, as often as desired, until substantially all of said usable material has been removed from said volumetric displacement device whereby said usable material may be removed from said volumetric displacement device in a low pressure, non-violent manner.

22. The method of claim 21 for removing said usable material from said volumetric displacement device where said displacement matter is compressed air.

23. A method for protecting the contents of an opened and partially consumed container of carbonated beverage comprising the steps of:

(a) providing a volumetric displacement device of claim 14 maintaining a substantially full-fill state, and (b) in an initial stage, occupying a usable material chamber of said volumetric displacement device with a positive initial volume of a usable material, and introducing a non-negative initial volume of a displacement matter into the displacement matter chamber of said volumetric displacement device separated from said displacement matter chamber using a displacement partition means comprising a flexible membrane, thereby substantially filling said volumetric displacement device and substantially causing said volumetric displacement device to attain a full fill state, and (c) waiting some period of time of undetermined duration, and (d) removing at least some volume of said usable material from said usable material chamber, leaving a remaining volume of said usable material, and (e) connecting a means for supplying compressed air to a means for bi-directional transport of displacement matter between the environment and said displacement matter chamber, and (f) introducing into said displacement matter chamber, a volume of new compressed air thereby substantially filling said volumetric displacement device and substantially causing said volumetric displacement device to attain a full fill state, and (g) disconnecting a displacement matter passageway disconnect means whereupon a displacement matter passageway valve means of said volumetric displacement device prevents air from exiting said displacement matter chamber after said disconnection, and (h) waiting some period of time of undetermined duration, and (i) repeatedly so-removing said usable material from said usable material chamber, and repeatedly so-connecting said a displacement matter passageway disconnect means, and so-introducing new compressed air into said displacement matter chamber, and repeatedly so-connecting said displacement matter passageway disconnect means, and so-waiting some period of time of undetermined duration, thereby allowing said volumetric displacement device to be placed into a conventional refrigerator while said displacement matter passageway disconnect means is disconnected, without putting said air compressor means or a power supply for said air compressing means, into said refrigerator and substantially continuously maintaining said device in a substantially-full state, as often as desired, until substantially all of said usable material has been removed from said volumetric displacement device.

24. A method for protecting the contents of an opened and partially consumed container of carbonated beverage comprising the steps of:

(a) providing a volumetric displacement device for maintaining a substantially full-fill state, and (b) in an initial stage, occupying a usable material chamber of said volumetric displacement device with a positive initial volume of a usable material, and introducing a non-negative initial volume of a displacement matter into the displacement matter chamber of said volumetric displacement device separated from said displacement matter chamber using a displacement partition means comprising a flexible membrane, thereby substantially filling said volumetric displacement device and substantially causing said volumetric displacement device to attain a full fill state, and (c) waiting some period of time of undetermined duration, and (d) removing at least some volume of said usable material from said usable material chamber, leaving a remaining volume of said usable material, and (e) connecting a means for supplying compressed air to a means for bi-directional transport of displacement matter between the environment and said displacement matter chamber, and (f) introducing into said displacement matter chamber, a volume of new compressed air thereby substantially filling said volumetric displacement device and substantially causing said volumetric displacement device to attain a full fill state, and (g) disconnecting said means for supplying compressed air from said means for bi-directional transport of displacement matter between the environment and said displacement matter chamber, and (h) waiting some period of time of undetermined duration, and (i) repeatedly so-removing said usable material from said usable material chamber, and repeatedly so-connecting said means for supplying compressed air to said means for bi-directional transport of displacement matter between the environment and said displacement matter chamber, and so-introducing new compressed air into said displacement matter chamber, and repeatedly so-disconnecting said means for supplying compressed air to the means for bi-directional transport of displacement matter between the environment and said displacement matter chamber, and so-waiting some period of time of undetermined duration, thereby allowing said volumetric displacement device to be placed into a conventional refrigerator while said means for supplying compressed air to the means for bi-directional transport of displacement matter between the environment and said displacement matter chamber is disconnected, without putting said air compressing means or a power supply for said air compressing means, into said refrigerator and substantially continuously maintaining said device in a substantially-full state, as often as desired, until substantially all of said usable material has been removed from said volumetric displacement device.

* * * * *